US007511238B2

(12) United States Patent
Sugane et al.

(10) Patent No.: US 7,511,238 B2
(45) Date of Patent: Mar. 31, 2009

(54) SWITCH ACTUATION DEVICE, INTERLOCK MECHANISM, AND IMAGE FORMING APPARATUS

(75) Inventors: Hirofumi Sugane, Machida (JP); Gakushi Tanaka, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/213,653

(22) Filed: Jun. 23, 2008

(65) Prior Publication Data

US 2009/0008231 A1 Jan. 8, 2009

(30) Foreign Application Priority Data

Jul. 6, 2007 (JP) ..... 2007-178810
Oct. 12, 2007 (JP) ..... 2007-266666

(51) Int. Cl.
*H01H 3/16* (2006.01)

(52) U.S. Cl. ..... 200/61.62; 200/61.73; 200/333

(58) Field of Classification Search ..... 200/17 R, 200/50.01, 50.1, 61.62, 61.7, 61.73, 61.74, 200/61.75, 61.76, 61.81, 518, 333, 334, 18; 361/212–214, 220, 680
See application file for complete search history.

(56) References Cited

U.S. PATENT DOCUMENTS 4,978,817 A * 12/1990 Honda ..... 200/50.1
6,784,387 B2 * 8/2004 Takano ..... 200/61.69
7,141,750 B2 * 11/2006 Yamada ..... 200/341
2007/0160386 A1 7/2007 Matsumoto et al.

FOREIGN PATENT DOCUMENTS

| | | |
|---|---|---|
| JP | 04-345175 | 12/1992 |
| JP | 11-296009 | 10/1999 |
| JP | 2002-258565 | 9/2002 |
| JP | 3620960 | 11/2004 |
| JP | 3754777 | 12/2005 |
| JP | 3993965 | 8/2007 |

OTHER PUBLICATIONS

Abstract of JP 11-272131 published Oct. 8, 1999.
Abstract of JP 2001-255792 published Sep. 21, 2001.
Abstract of JP 10-162684 published Jun. 19, 1998.

* cited by examiner

*Primary Examiner*—Michael A Friedhofer
(74) *Attorney, Agent, or Firm*—Harness, Dickey & Pierce, P.L.C.

(57) ABSTRACT

A switch actuation device includes a first actuation portion driven by a first moving member and a second actuation portion driven by a second moving member. The switch actuation device further includes a first lever, a second lever, and an actuator. The first actuation portion contacts the second lever to swing the second lever toward the actuator connected to a switch when driven by the first moving member. The second actuation portion swings the first lever to cause the first lever to move the second lever closer to the actuator when driven by the second moving member. The actuator is driven by a combination of the swing of the second lever caused by the first moving member and the movement of the second lever caused by the second moving member so as to turn on the switch.

20 Claims, 22 Drawing Sheets

FIG. 25

| FRONT COVER | RIGHT COVER | SWITCH |
|---|---|---|
| OPENED | OPENED | OFF |
| OPENED | CLOSED | OFF |
| CLOSED | OPENED | OFF |
| CLOSED | CLOSED | ON |

SWITCH ACTUATION DEVICE, INTERLOCK MECHANISM, AND IMAGE FORMING APPARATUS

PRIORITY STATEMENT

The present patent application claims priority from Japanese Patent Application Nos. 2007-178810, filed on Jul. 6, 2007, and 2007-266666, filed on Oct. 12, 2007 in the Japan Patent Office, the entire contents of each of which are hereby incorporated herein by reference.

BACKGROUND OF THE INVENTION

1. Field of the Invention

Example embodiments generally relate to a switch actuation device, an interlock mechanism, and an image forming apparatus including the switch actuation device, for example, for actuating a switch.

2. Description of the Related Art

A related-art image forming apparatus, such as a copier, a printer, a facsimile machine, or a multifunction printer having at least one of copying, printing, scanning, and facsimile functions, typically forms an image on a sheet. To remove a jammed sheet or to replace consumables, such as a toner container, a cover of the image forming apparatus may be opened and closed. As a safety feature, an interlock mechanism included in the image forming apparatus may be turned on and off in correspondence with closing and opening of the cover so as to turn on and off a power source of the image forming apparatus. For example, when the cover is opened, the interlock mechanism is turned off to turn off the power source. Such interlock mechanism includes a switch connected to the power source.

Generally, the image forming apparatus includes a plurality of covers. If a plurality of interlock mechanisms is provided to correspond to the plurality of covers, a number of interlock mechanisms is increased, occupying a larger space and increasing manufacturing costs.

To address such problem, one example of the image forming apparatus includes a right lever provided on a right cover, a left lever provided on a left cover, and an actuation member provided on a front cover. The right lever and the left lever overlap each other at an overlap position at which a switch actuator is provided. When the front cover is closed and the actuation member provided on the front cover presses the overlapped right and left levers at the overlap position, the switch actuator turns on an interlock switch.

Another example of the image forming apparatus includes two front covers. When one of the two front covers is closed according to a predetermined order, a protrusion provided on the closed front cover presses a pair of engaged levers so as to disengage the levers. When another one of the two front covers is closed, one of the levers rotates to turn on an interlock switch.

However, in the above-described image forming apparatuses, when the plurality of covers is not closed in the predetermined order, the interlock switch may not be turned on.

To address this problem, yet another example of the image forming apparatus includes a front cover, a side cover, and a top cover. When one of the front cover and the side cover is closed, a link member swings to turn on an interlock switch. Even when the front cover and the side cover are not closed in a predetermined order, the top cover may swing the link member to turn on the interlock switch. However, an extra cover, that is, the top cover, is needed to turn on the interlock switch, resulting in a larger size of the image forming apparatus.

Yet another example of the image forming apparatus includes a plurality of swing members to turn on an interlock switch even when covers are not closed in a predetermined order. When the covers contact pivoting ends of the swing members, respectively, the swing members turn on the interlock switch. The covers need to have contact areas corresponding to swing strokes of the swing members, respectively. Therefore, when the covers and the swing members are not manufactured precisely or when an amount of opening and closing of the covers varies, the swing members may not swing properly, resulting in unstable or unreliable actuation of the interlock switch.

Moreover, in the image forming apparatuses in which the interlock switch may be turned on even when the plurality of covers is not closed in the predetermined order, a user of the image forming apparatus may not easily identify which cover is opened when the image forming apparatus is accidentally powered off.

Obviously, such increased size of the image forming apparatus and unreliable actuation of the interlock switch are undesirable, and accordingly, there is a need for a technology to provide stable actuation of the interlock switch with a compact structure and easy identification of an accidentally opened cover.

SUMMARY

At least one embodiment may provide a switch actuation device that turns on and off a switch by movements of a plurality of moving members including a first moving member and a second moving member. The switch actuation device includes a first actuation portion driven by the first moving member and a second actuation portion driven by the second moving member. The switch actuation device further includes a first lever, a support shaft, a second lever, and an actuator. The first lever opposes the second actuation portion and is swung by the second actuation portion when the second moving member contacts the second actuation portion. The support shaft is provided on the first lever. The second lever opposes the first actuation portion and is swung about the support shaft by the first actuation portion when the first moving member drives the first actuation portion. The actuator opposes the second lever and is connected to the switch. The second lever includes a first pivoting end opposing the actuator and a second pivoting end provided opposite to the first pivoting end via the support shaft. The first actuation portion contacts the second pivoting end of the second lever to swing the second lever toward the actuator when driven by the first moving member. The second actuation portion swings the first lever to cause the first lever to move the second lever closer to the actuator when driven by the second moving member. The actuator is driven by a combination of the swing of the second lever caused by the first moving member and the movement of the second lever caused by the second moving member so as to turn on the switch.

At least one embodiment may provide an interlock mechanism that includes a switch and a switch actuation device. The switch is used as an open-close detection switch for detecting opening and closing of a plurality of covers including a first cover and a second cover. The switch actuation device turns on and off the switch by movements of a plurality of moving members including a first moving member provided on the first cover and a second moving member provided on the second cover. The switch actuation device includes a first actuation portion driven by the first moving member and a second actuation portion driven by the second moving member. The switch actuation device further includes a first lever, a support shaft, a second lever, and an actuator. The first lever opposes the second actuation portion and is swung by the second actuation portion when the second moving member contacts the second actuation portion. The support shaft is provided on the first lever. The second lever opposes the first actuation portion and is swung about the support shaft by the first actuation portion when the first moving member drives the first actuation portion. The actuator opposes the second lever and is connected to the switch. The second lever includes a first pivoting end opposing the actuator and a second pivoting end provided opposite to the first pivoting end via the support shaft. The first actuation portion contacts the second pivoting end of the second lever to swing the second lever toward the actuator when driven by the first moving member. The second actuation portion swings the first lever to cause the first lever to move the second lever closer to the actuator when driven by the second moving member. The actuator is driven by a combination of the swing of the second lever caused by the first moving member and the movement of the second lever caused by the second moving member so as to turn on the switch.

At least one embodiment may provide an image forming apparatus that includes an interlock mechanism including a switch and a switch actuation device. The switch is used as an open-close detection switch for detecting opening and closing of a plurality of covers including a first cover and a second cover. The switch actuation device turns on and off the switch by movements of a plurality of moving members including a first moving member provided on the first cover and a second moving member provided on the second cover. The switch actuation device includes a first actuation portion driven by the first moving member and a second actuation portion driven by the second moving member. The switch actuation device further includes a first lever, a support shaft, a second lever, and an actuator. The first lever opposes the second actuation portion and is swung by the second actuation portion when the second moving member contacts the second actuation portion. The support shaft is provided on the first lever. The second lever opposes the first actuation portion and is swung about the support shaft by the first actuation portion when the first moving member drives the first actuation portion. The actuator opposes the second lever and is connected to the switch. The second lever includes a first pivoting end opposing the actuator and a second pivoting end provided opposite to the first pivoting end via the support shaft. The first actuation portion contacts the second pivoting end of the second lever to swing the second lever toward the actuator when driven by the first moving member. The second actuation portion swings the first lever to cause the first lever to move the second lever closer to the actuator when driven by the second moving member. The actuator is driven by a combination of the swing of the second lever caused by the first moving member and the movement of the second lever caused by the second moving member so as to turn on the switch.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein:

FIG. 25 is a lookup table showing a relation between opening and closing of a front cover and a right cover included in the image forming apparatus shown in FIG. 16 and turning on and off of a switch included in the switch actuation device shown in FIG. 19.

Figure 1:
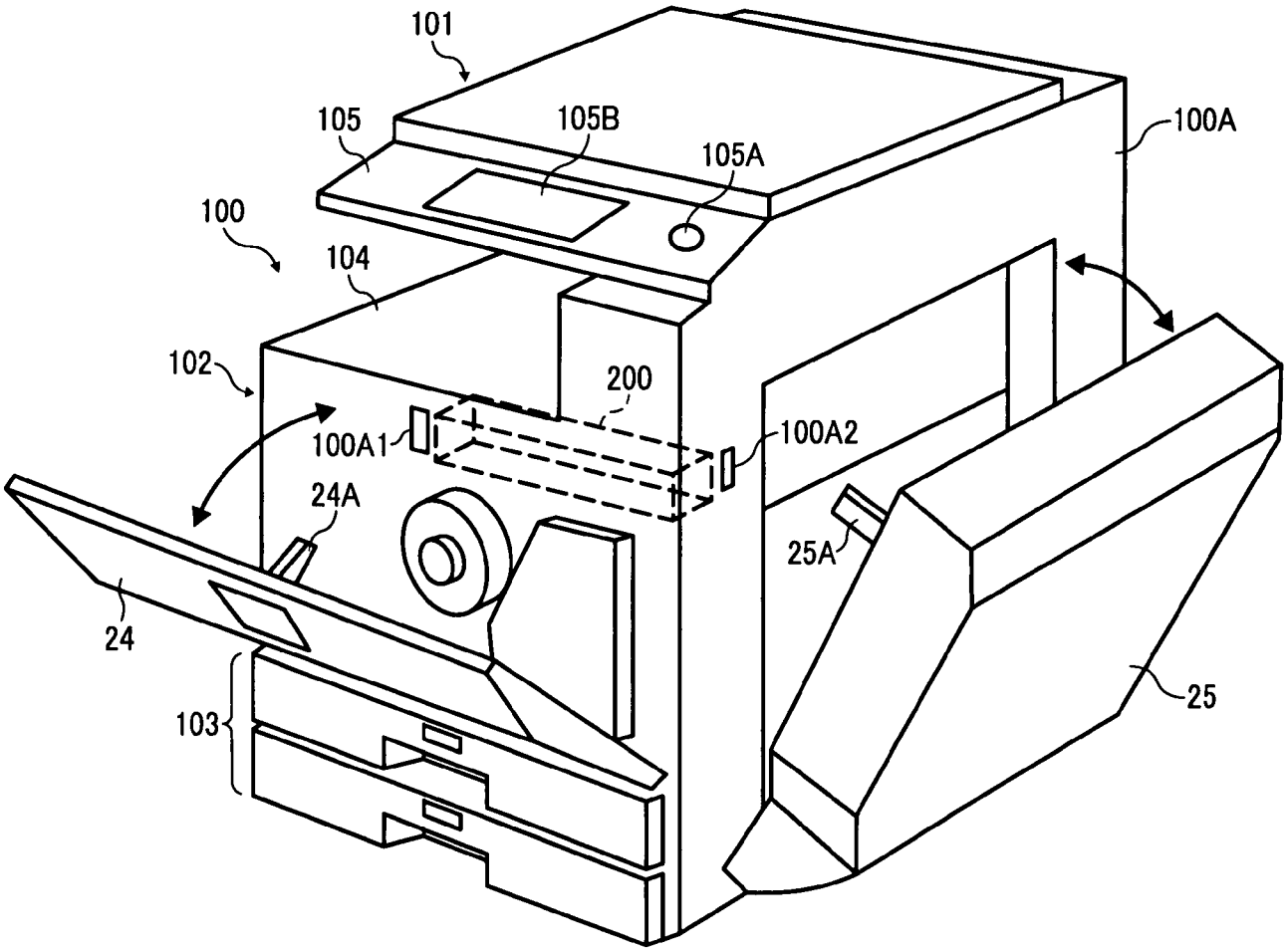
FIG. 1 is a perspective view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected, to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may, be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 100 according to an example embodiment is explained.

FIG. 1 is a perspective view of the image forming apparatus 100. The image forming apparatus 100 includes a body 100A. The body 101A includes a scanner 101, an image forming device 102, paper trays 103, an output tray 104, a control panel 105, a front cover 24, a right cover 25, protrusions 24A and 25A, openings 100A1 and 100A2, and/or a switch actuation device 200. The control panel 105 includes an LCD (liquid crystal display) 105B and/or a control key 105A.

The image forming apparatus 100 can be a copier, a facsimile machine, a printer, a plotter, a multifunction printer having at least one of copying, printing, scanning, plotter, and facsimile functions, or the like. According to this example embodiment, the image forming apparatus 100 functions as a copier for forming an image on a recording medium.

The scanner 101 is provided in an upper portion of the body 100A. The scanner 101 scans an image on an original document to generate image data and sends the image data to the image forming device 102 included in the body 100A. The image forming device 102 is provided in a center portion of the body 100A in a vertical direction. The paper trays 103 are provided under the image forming device 102 and load a recording medium (e.g., recording sheets). The output tray 104 is provided in a space between the scanner 101 and the image forming device 102 in the vertical direction. The control panel 105 is provided in front of the scanner 101 in such a manner that the control panel 105 protrudes from the body 100A. The control key 105A and the LCD 105B serve as a user interface through which a user operates the image forming apparatus 100.

The front cover 24 is provided in a front of the body 100A and rotates (e.g., swings) about a shaft provided in a bottom of the front cover 24 so that the front cover 24 is opened and closed. The right cover 25 is provided in a right (e.g., a side perpendicular to the front) of the body 100A and rotates (e.g., swings) about a shaft provided in a bottom of the right cover 25 so that the right cover 25 is opened and closed. The protrusion 24A protrudes from an inner surface of the front cover 24 toward an interior of the body 100A. The protrusion 25A protrudes from an inner surface of the right cover 25 toward the interior of the body 100A. The protrusions 24A and 25A serve as moving members for moving in accordance with opening and closing of the front cover 24 and the right cover 25, respectively.

The protrusion 24A is provided at a center of the inner surface of the front cover 24 in a horizontal direction. The protrusion 25A is provided at a position on the inner surface of the right cover 25 near the front cover 24. The openings 100A1 and 100A2 are provided in the body 100A and oppose the protrusions 24A and 25A, respectively. Thus, the protrusions 24A and 25A are inserted into the openings 100A1 and 100A2, respectively.

For example, the opening 100A2 opposing the protrusion 25A of the right cover 25 is provided near a corner of a right side of the body 100A, which is adjacent and perpendicular to a front side of the body 100A on which the front cover 24 is provided. The switch actuation device 200 is provided in a space inside the body 101A enclosed by the openings 100A1 and 100A2.

Figure 2:
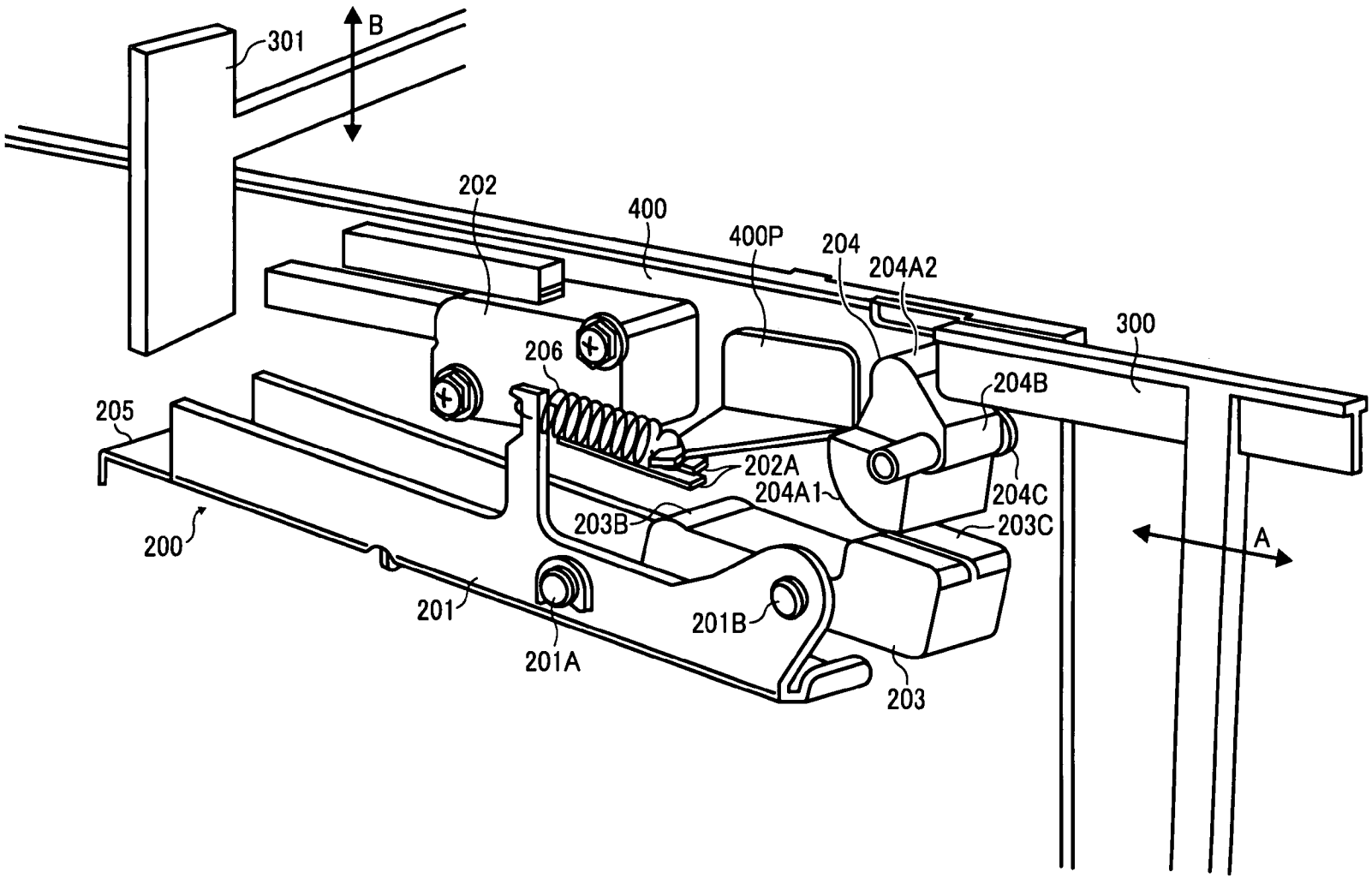
FIG. 2 is a perspective view (according to an example embodiment) of a switch actuation device included in the image forming apparatus shown in FIG. 1.

FIG. 2 is a perspective view of the switch actuation device 200, a switch 202, and moving members 300 and 301. The switch actuation device 200 includes a first lever 201, a support 201A, a support shaft 201B, a second lever 203, an actuator 202A, a first actuation portion 204, a second actuation portion 205, an elastic member 206, a support bracket 400P, and/or a frame 400. The first actuation portion 204 includes an arc portion 204A1, a contact portion 204A2, a rotation shaft 204B, and/or an elastic member 204C. The second lever 203 includes a first pivoting end 203B and/or a second pivoting end 203C.

The first lever 201 swings about the support 201A on a vertical plane, and has a swing habit for swinging in one direction as a default habit. One end of the first lever 201 supports the support shaft 201B. The support shaft 201B supports the second lever 203 in such a manner that both ends (e.g., the first pivoting end 203B and the second pivoting end 203C) of the second lever 203 swing about the support shaft 201B on a vertical plane. One pivoting end (e.g., the first pivoting end 203B) of the second lever 203 opposes the actuator 202A for actuating the switch 202. Another pivoting end (e.g., the second pivoting end 203C) of the second lever 203 opposes the first actuation portion 204. When the moving member 300, serving as a first moving member, moves the first actuation portion 204, the first actuation portion 204 contacts the second pivoting end 203C of the second lever 203 and swings the second lever 203, so that the first pivoting end 203B moves toward the actuator 202A. The moving member 301, serving as a second moving member, opposes the second actuation portion 205 provided at another end of the first lever 201. When the moving member 301 contacts the second actuation portion 205, the second actuation portion 205 swings the first lever 201 against the default habit of the first lever 201 to cause the second lever 203 to move closer to the actuator 202A.

The elastic member 206 (e.g., a coil spring), serving as a biasing mechanism, applies the default habit to the first lever 201. One end of the elastic member 206 is hooked on the first lever 201. The moving member 300 moves in directions different from directions in which the moving member 301 moves. For example, the moving member 300 moves in horizontal directions A and the moving member 301 moves in vertical directions B.

Another end of the elastic member 206 is hooked on the support bracket 400P attached to the frame 400. The frame 400 is fixed to the body 100A (depicted in FIG. 1). Thus, the elastic member 206 applies a habit for swinging the first lever 201 clockwise in FIG. 2 about the support 201A to the first lever 201.

The first actuation portion 204 includes a cam-shaped rotating member. The rotation shaft 204B supported by the frame 400 penetrates the first actuation portion 204. The first actuation portion 204 includes the arc portion 204A1 and the contact portion 204A2. The arc portion 204A1, serving as a cam-shaped portion or a cam, has a reference radius. The contact portion 204A2 is provided at a position relative to the arc portion 204A1 via the rotation shaft 204B, and is pushed and moved by the moving member 300.

When the arc portion 204A1 contacts the second pivoting end 203C of the second lever 203, which does not oppose the switch 202, the second lever 203 may swing in a first mode or a second mode. In the first mode, the second lever 203 moves closer to the actuator 202A and swings about a contact position, at which the arc portion 204A1 contacts the second pivoting end 203C of the second lever 203, to push and move the actuator 202A. In the second mode, the second lever 203 moves closer to the actuator 202A and swings about the rotation shaft 201B to push and move the actuator 202A.

In the first mode, the moving member 300 causes the arc portion 204A1 of the first actuation portion 204 to contact the second pivoting end 203C of the second lever 203 and the moving member 301 pushes and moves the first lever 201. For example, when the first lever 201 swings in a direction for moving the second lever 203 closer to the switch 202, the support shaft 201B supporting the second lever 203 is displaced, but the arc portion 204A1 of the first actuation portion 204 prevents one pivoting end (e.g., the second pivoting end 203C) of the second lever 203 from moving. Therefore, another pivoting end (e.g., the first pivoting end 203B) of the second lever 203, which opposes the actuator 202A, moves closer to the actuator 202A and the second lever 203 swings about a position at which the arc portion 204A1 prevents movement of the second pivoting end 203C of the second lever 203 in a direction in which the first pivoting end 203B of the second lever 203 pushes and moves the actuator 202A.

In the second mode, after the first lever 201 swings in a direction for moving the second lever 203 closer to the switch 202, the moving member 300 pushes and moves the first actuation portion 204. For example, when the first actuation portion 204 presses the second pivoting end 203C of the second lever 203 already swung and displaced in the direction in which the first lever 201 moves the second lever 203 closer to the switch 202, the second lever 203 swings about the support shaft 201B in a direction in which the first pivoting end 203B of the second lever 203 moves closer to the actuator 202A to push and move the actuator 202A.

The elastic member 204C (e.g., a coil spring) is wound around the rotation shaft 204B and applies a force to the arc portion 204A1 so that one end of the arc portion 204A1 in a circumferential direction of the arc portion 204A1 constantly opposes the second pivoting end 203C of the second lever 203. Therefore, the first actuation portion 204 does not slide and generate a stroke but rotates on a surface of the second pivoting end 203C of the second lever 203. Thus, the first actuation portion 204 may oppose and contact a substantially identical position on the surface of the second pivoting end 203C of the second lever 203.

In addition to a function for positioning the arc portion 204A1, the elastic member 204C has a damper function for absorbing an excessive stroke by torsion when the moving member 300 generates an abnormal motion stroke.

The second actuation portion 205 is provided at one end of the first lever 201 opposite to another end of the first lever 201 where the second lever 203 is provided. The second actuation portion 205 swings the first lever 201 so that the moving member 300 pushes and moves the second lever 203 closer to the switch 202.

According to this example embodiment, in the switch actuation device 200 having the above-described structure, even when one of the moving members 300 and 301 moves before another one of the moving members 300 and 301, turning on a single switch (e.g., the switch 202) may detect movement of both of the moving members 300 and 301.

For example, when the arc portion 204A1 of the first actuation portion 204 contacts the second pivoting end 203C of the second lever 203, the swinging first lever 201 changes a position of the support shaft 201B provided on the swinging first lever 201. The second lever 203 may swing in accordance with the change of the position of the support shaft 201B. However, the first actuation portion 204 engages with the second pivoting end 203C of the second lever 203. Therefore, the second lever 203 swings about the support shaft 201B in a direction in which the first pivoting end 203B of the second lever 203 opposite to the second pivoting end 203C engaged with the first actuation portion 204 pushes and moves the actuator 202A.

Namely, when the first lever 201 swings in accordance with movement of the moving members 300 and/or 301 or finishes swinging, the first actuation portion 204 contacting the second lever 203 may cause the second lever 203 to turn on the switch 202.

According to this example embodiment, a single switch (e.g., the switch 202) may detect movement of a plurality of moving members (e.g., the moving members 300 and 301) moving in directions different from each other. Further, levers (e.g., the first lever 201 and the second lever 203) pushed and moved by the plurality of moving members, respectively, may not have an engaging structure for engaging the levers with each other. Accordingly, a structure for disengaging the levers may not be needed.

If the first actuation portion 204 is configured to slide and contact the second lever 203, the first actuation portion 204 may cause an unstable switch operation due to change in a stroke for actuating the actuator 202A when a slide portion of the first actuation portion 204 at which the first actuation portion 204 slides on the second lever 203 is not processed precisely. By contrast, according to this example embodiment, the first actuation portion 204 rotates and contacts the second lever 203, preventing the unstable switch operation.

According to this example embodiment, the moving members 300 and 301 move in directions perpendicular to each other. However, the moving members 300 and 301 may move in identical directions as described below by referring to FIG. 3. Further, according to this example embodiment, both ends of the first lever 201 swing about the support 201A and both ends of the second lever 203 swing about the support shaft 201B. Alternatively, a support and a support shaft may be provided at one end of the first lever 201 and the second lever 203, respectively, and a swing member may press a center of the first lever 201 or the second lever 203.

According to this example embodiment, the elastic member 206 applies a default habit to the first lever 201. Alternatively, a weight of the first lever 201 may apply a default habit to the first lever 201 in one direction.

According to this example embodiment, when the circumferential surface of the first actuation portion 204 rotates and contacts the second lever 203 to swing the second lever 203, the first actuation portion 204 contacts an identical position on the second lever 203. Alternatively, the first actuation portion 204 may contact various positions on the second lever 203.

Figure 3:
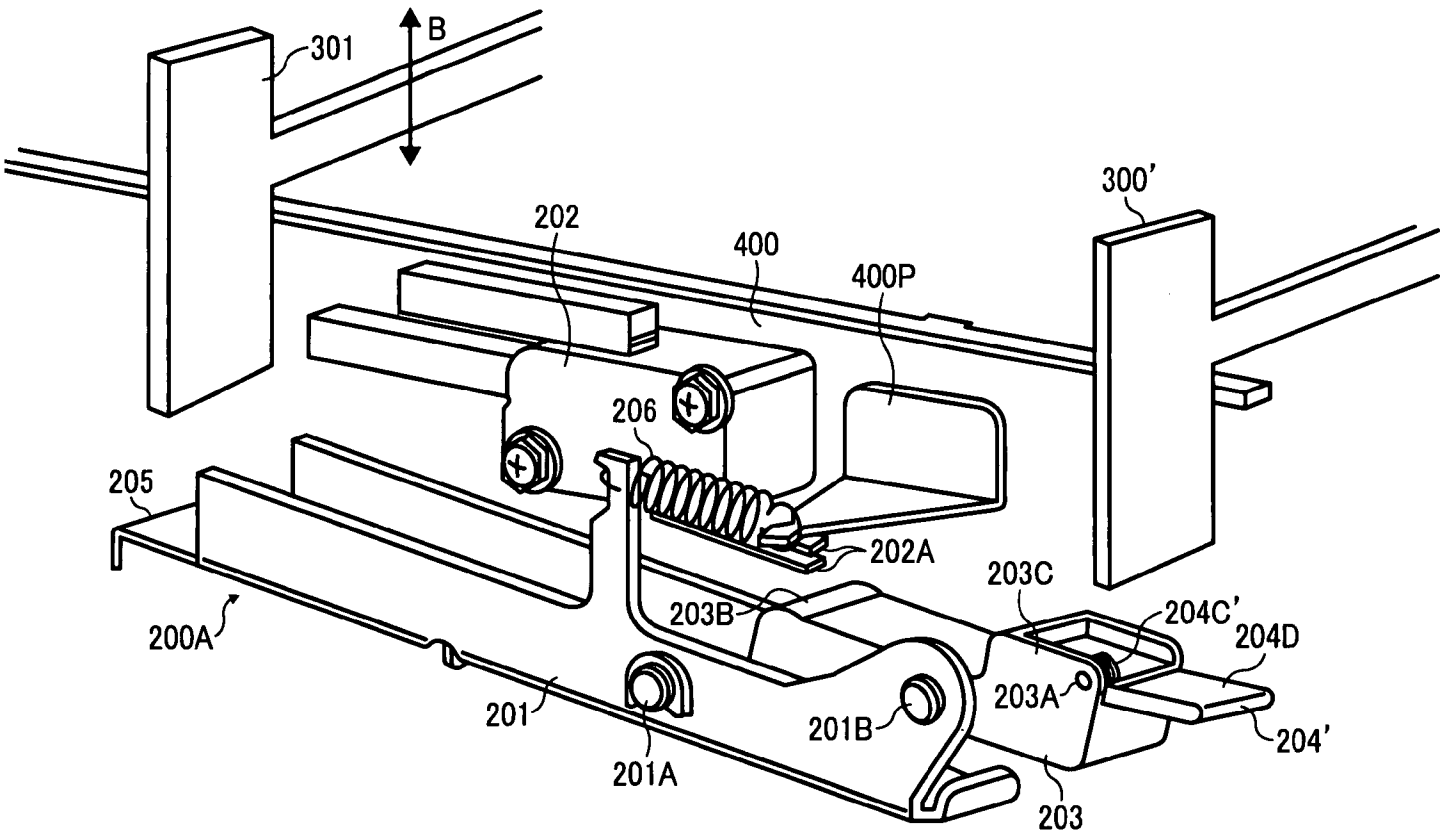
FIG. 3 is a perspective view of a switch actuation device according to another example embodiment.

Referring to FIG. 3, the following describes a switch actuation device 200A as a modified example of the switch actuation device 200 (depicted in FIG. 2) according to another example embodiment. FIG. 3 is a perspective view of the switch actuation device 200A, the moving member 301, and a moving member 300'. The moving member 300' replaces the moving member 300 (depicted in FIG. 2) and a first actuation portion 204' replaces the first actuation portion 204 (depicted in FIG. 2). The first actuation portion 204' includes a flange 204D and/or an elastic member 204C'. The second lever 203 includes a support shaft 203A. The other elements of the switch actuation device 200A are common to the switch actuation device 200.

The moving member 300' moves in the vertical directions B in which the moving member 301 moves. The moving member 300' pushes and moves the first actuation portion 204'. The support shaft 203A is provided in the second lever 203 and supports a base end of the swingable flange 204D.

The elastic member 204C' (e.g., a coil spring) is provided on the support shaft 203A. When the moving member 300' generates an excessive stroke greater than a stroke needed for the second lever 203 to push and move the actuator 202A, the elastic member 204C' may absorb the excessive stroke by torsion.

For example, when the excessive stroke causes the moving member 300' to contact the first actuation portion 204', the second lever 203 swings for an amount corresponding to a stroke needed for the second lever 203 to push and move the actuator 202A, but the second lever 203 does not swing further because the first actuation portion 204' is displaced downward. Consequently, an excessive stroke generated by the moving member 300' does not swing the second lever 203. Thus, the second lever 203 does not push the actuator 202A excessively.

Figure 4:
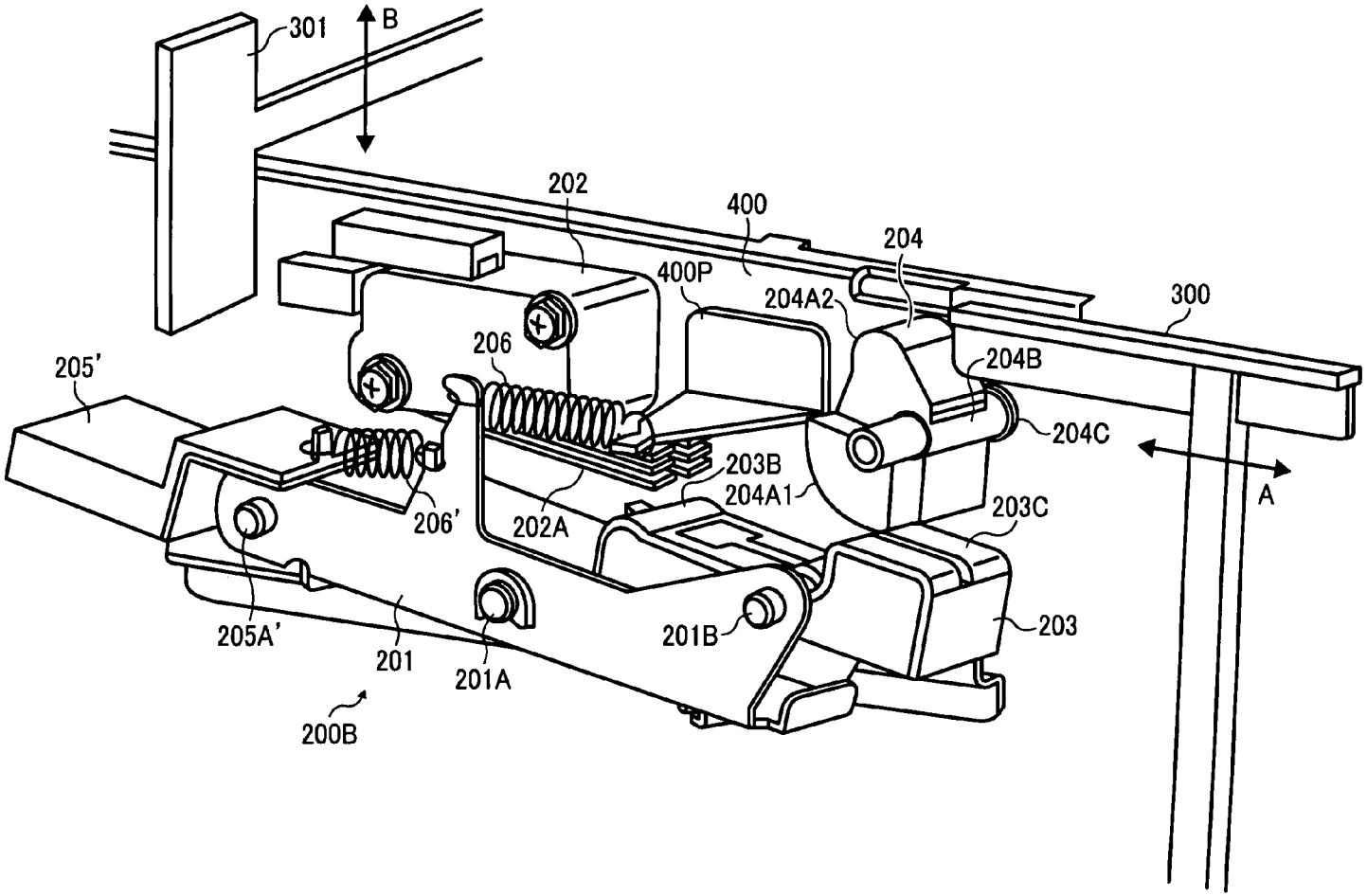
FIG. 4 is a perspective view of a switch actuation device according to yet another example embodiment.

Referring to FIG. 4, the following describes a switch actuation device 200B as another modified example of the switch actuation device 200 (depicted in FIG. 2) according to yet another example embodiment. FIG. 4 is a perspective view of the switch actuation device 200B and the moving members 300 and 301. The switch actuation device 200B includes a second actuation portion 205' instead of the second actuation portion 205 (depicted in FIG. 2), a support shaft 205A', and/or an elastic member 206'. The other elements of the switch actuation device 200B are common to the switch actuation device 200.

The support shaft 205A is rotatably provided in one pivoting end of the first lever 201 and supports a base end of the second actuation portion 205'. The second actuation portion 205' serves as a rotatable wing member and includes a surface opposing the moving member 301.

The elastic member 206' (e.g., a spring), serving as a biasing mechanism, is hooked on a part of the wing member, used as the second actuation portion 205', and the first lever 201. Like the elastic member 204C (depicted in FIG. 2) and the elastic member 204C' (depicted in FIG. 3), the elastic member 206' has a damper function for absorbing an excessive stroke by torsion when the moving member 301 generates an abnormal motion stroke to the first lever 201.

Figure 5:
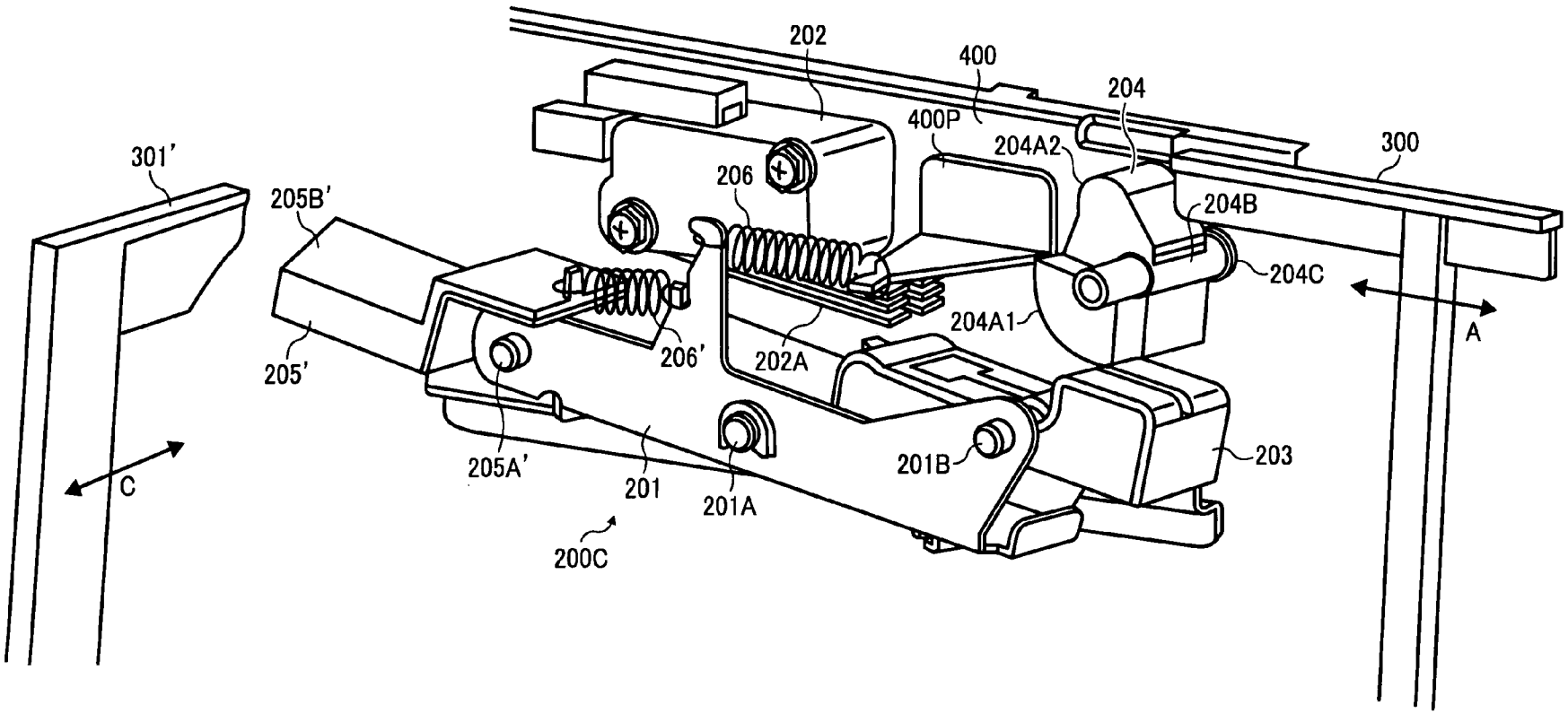
FIG. 5 is a perspective view of a switch actuation device according to yet another example embodiment.

Referring to FIG. 5, the following describes a switch actuation device 200C as a modified example of the switch actuation device 200B (depicted in FIG. 4) according to yet another example embodiment. FIG. 5 is a perspective view of the switch actuation device 200C, the moving member 300, and a moving member 301'. The second actuation portion 205' includes a slope 205B'. The other elements of the switch actuation device 200C are common to the switch actuation device 200B.

Like the moving member 300, the moving member 301' moves in horizontal directions. However, horizontal directions C in which the moving member 301' moves are perpendicular to the horizontal directions A in which the moving member 300 moves. The slope 205B' opposes the moving member 301' moving toward the switch actuation device 200C. The slope 205B' has a gradient capable of swinging the first lever 201 against a default habit when the moving member 301' presses the slope 205B'.

According to this example embodiment, even when the moving member 301' is not processed with a stable precision, the slope 205B' may push and move the first lever 201 properly. Consequently, the first lever 201 may swing the second lever 203 properly to turn on the switch 202. Further, when a direction in which the slope 205B' is formed is changed, movement of the moving member 301' which moves in a direction different from a direction in which the first lever 201 is displaced may change swing of the first lever 201. Thus, relative positions of the moving member 301' and the slope 205B' opposing each other may be adjusted according to placement of the image forming apparatus 100 (depicted in FIG. 1). Further, a shape of an opposing surface of the moving member 301' opposing the slope 205B' may be modified to absorb an impact applied to the first lever 201 to move the first lever 201 smoothly and calmly.

The elastic member 206' (e.g., a spring), serving as a biasing mechanism, is provided between the second actuation portion 205' and the first lever 201. In this case, the second actuation portion 205' may be integrated with the first lever 201. Therefore, like the elastic member 204C included in the first actuation portion 204, when the moving member 301' generates an abnormal stroke, the elastic member 206' provides a damper function in which the second actuation portion 205' rotates independently to absorb an excessive stroke, preventing a faulty operation of the second lever 203 for the switch 202 which may occur when an amount of swing of the first lever 201 accidentally increases.

Figure 6:
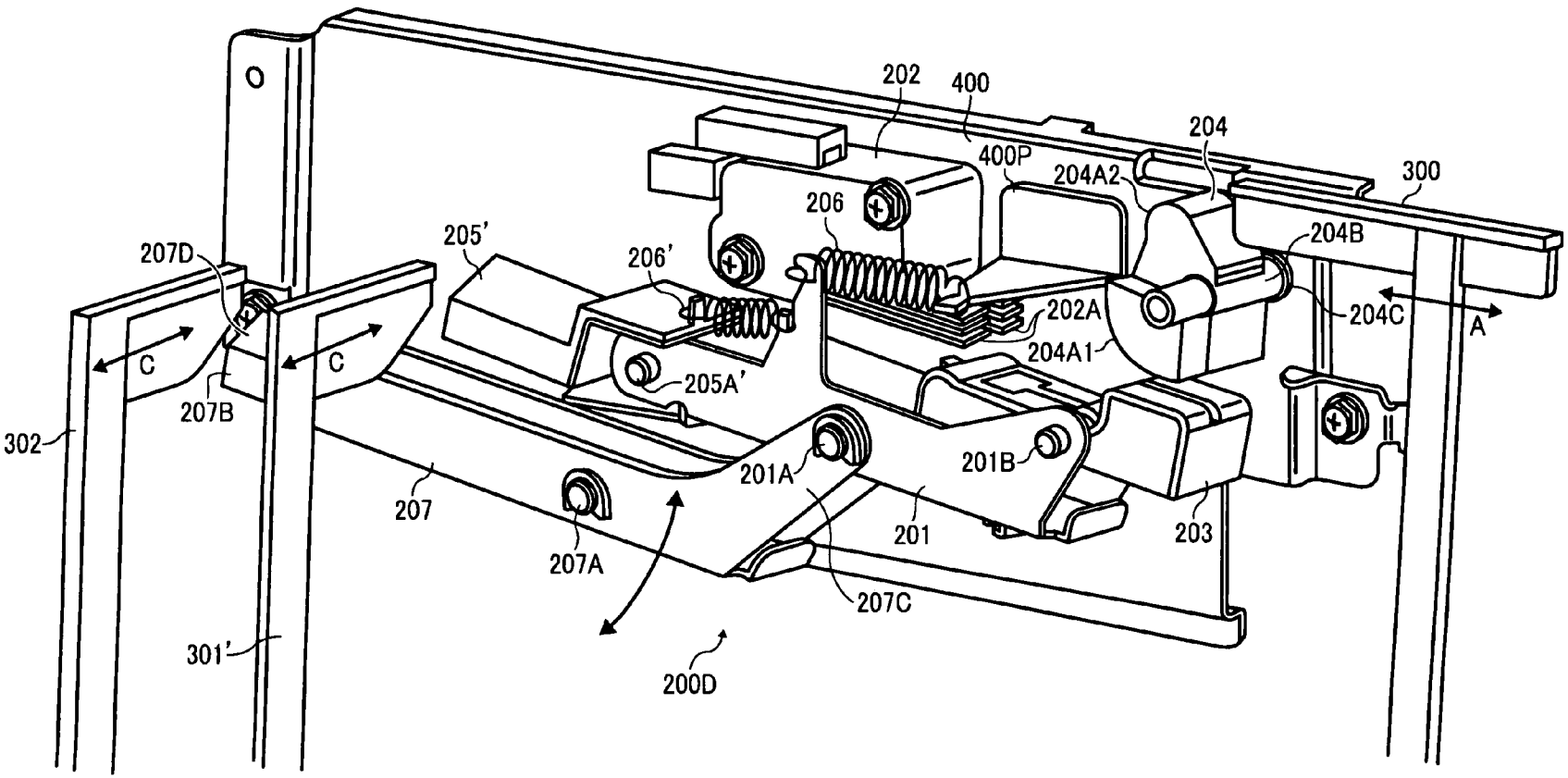
FIG. 6 is a perspective view of a switch actuation device according to yet another example embodiment.

Referring to FIG. 6, the following describes a switch actuation device 200D according to yet another example embodiment. FIG. 6 is a perspective view of the switch actuation device 200D, the moving member 300, the moving member 301', and a moving member 302. The switch actuation device 200D includes a third actuation portion 207B, a third lever 207, and/or a support 207A. The third lever 207 includes a third pivoting end 207C and/or a fourth pivoting end 207D. The other elements of the switch actuation device 200D are common to the switch actuation device 200C (depicted in FIG. 5).

The switch actuation device 200D may correspond to an additional moving member. According to the above-described example embodiments, the support 201A for supporting the first lever 201 is attached to the frame 400. However, according to this example embodiment, the support 201A is not attached to the frame 400, but the support 207A for supporting the third lever 207 is attached to the frame 400. The third lever 207 supports the first lever 201.

Like the first lever 201, both ends of the third lever 207 are swingable about the support 207A. One pivoting end (e.g., the third pivoting end 207C) of the third lever 207 supports the support 201A for supporting the first lever 201. The third actuation portion 207B is provided on another pivoting end (e.g., the fourth pivoting end 207D) of the third lever 207 and includes a slope equivalent to the slope 205B' of the switch actuation device 200C (depicted in FIG. 5). The moving member 302 opposes the third actuation portion 207B in such a manner that the moving member 302 is movable in the horizontal directions C. Namely, the moving members 300, 301', and 302 are movable in the horizontal directions (e.g., the horizontal directions A and C).

According to this example embodiment, the moving members 300 and 301' swing the first lever 201 and/or the second lever 203 in a direction in which the first lever 201 and/or the second lever 203 moves closer to the switch 202. In addition, the third lever 207 swings and lifts the first lever 201. Therefore, even when a moving member (e.g., the moving member 302) is added to the image forming apparatus 100 (depicted in FIG. 1) including the moving members 300 and 301', the added moving member 302 swings and drives the third lever 207 and thereby the third lever 207 lifts the first lever 201. Moreover, the first actuation portion 204 drives the second lever 203 and thereby the second lever 203 swings with an increased swing radius. Accordingly, a pivoting end of the first lever 201, which supports the second lever 203, may swing with a small swing stroke in correspondence with movement of the moving member 300. Thus, the second lever 203 may correspond to movement of the moving member 300 with an increased sensitivity so as to turn on the switch 202 with an increased accuracy. Further, even when the moving members 300, 301', and/or 302 move in various directions, a single switch (e.g., the switch 202) may correspond to movement of the moving members 300, 301', and/or 302.

Figure 7:
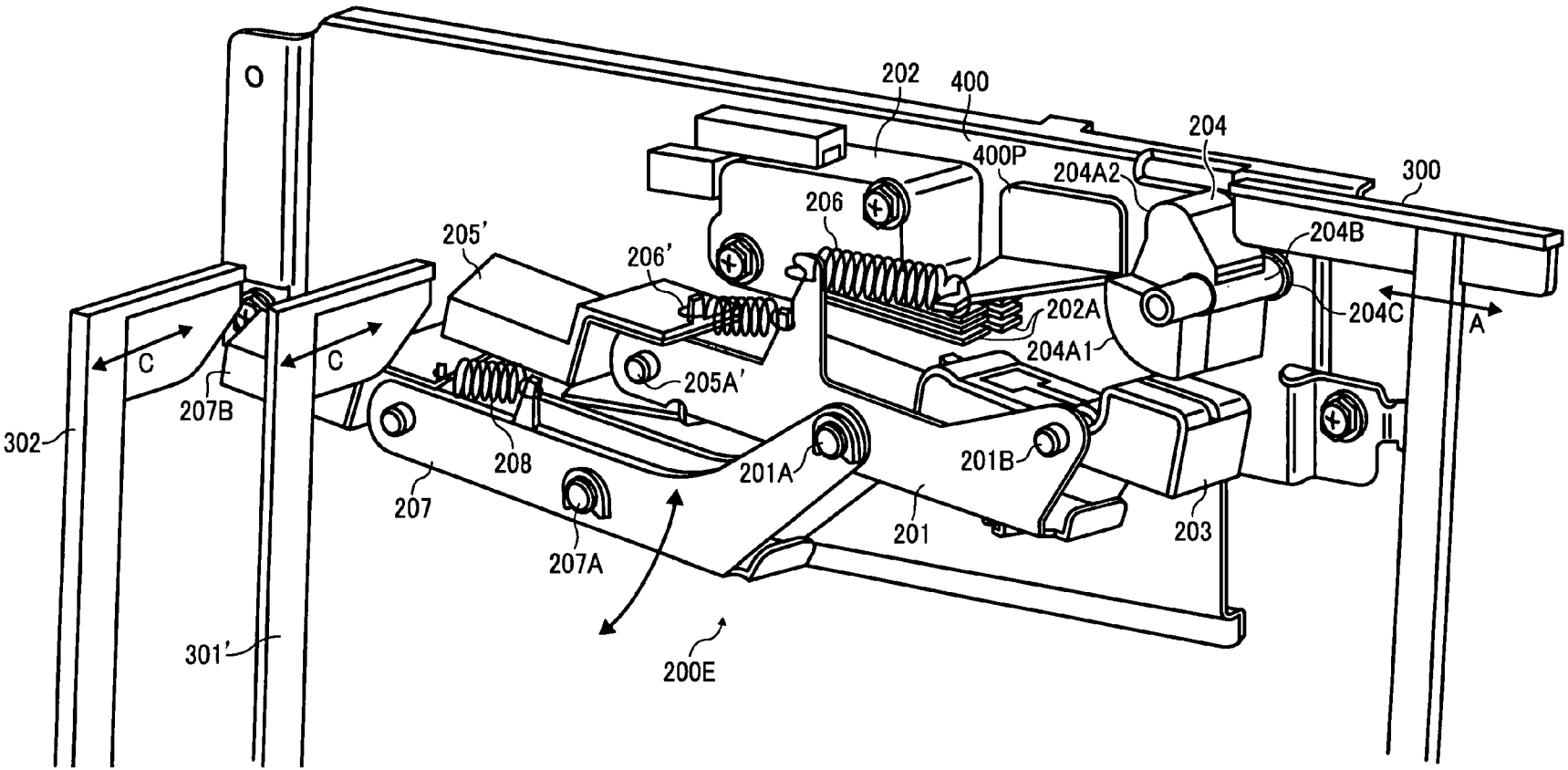
FIG. 7 is a perspective view of a switch actuation device according to yet another example embodiment.

Referring to FIG. 7, the following describes a switch actuation device 200E according to yet another example embodiment. FIG. 7 is a perspective view of the switch actuation device 200E and the moving members 300, 301', and 302. The switch actuation device 200E includes an elastic member 208. The other elements of the switch actuation device 200E are common to the switch actuation device 200D (depicted in FIG. 6).

The elastic member 208 is hooked on the third actuation portion 207B and the third lever 207. The elastic member 208 has a damper function for absorbing an excessive stroke by torsion when the moving member 302 generates an abnormal motion stroke to the third lever 207, like the elastic member 206' providing the damper function for the first lever 201.

Figure 8:
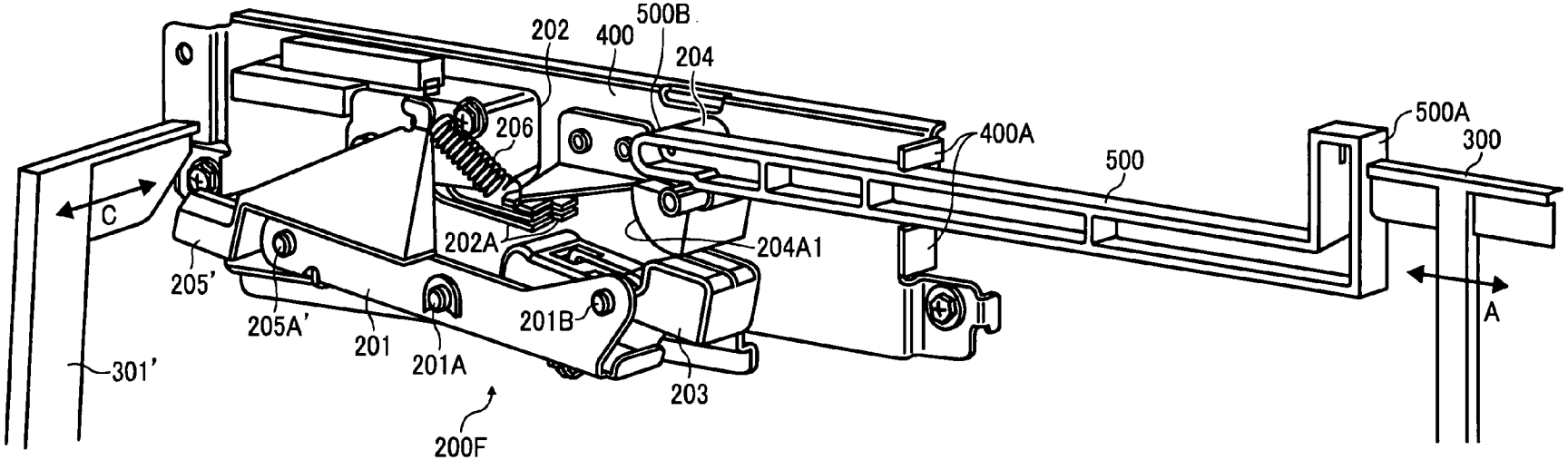
FIG. 8 is a perspective view of a switch actuation device according to yet another example embodiment.

Referring to FIG. 8, the following describes a switch actuation device 200F according to yet another example embodiment. FIG. 8 is a perspective view of the switch actuation device 200F and the moving members 300 and 301'. The switch actuation device 200F includes a link member 500 and/or a guide 400A. The link member 500 includes a vertical portion 500A and/or a horizontal portion 500B. The switch actuation device 200F does not include the elastic member 206' (depicted in FIG. 5). The other elements of the switch actuation device 200F are common to the switch actuation device 200C (depicted in FIG. 5).

The link member 500 is provided between the first actuation portion 204 and the moving member 300 and opposes the first actuation portion 204. The link member 500 has an L-like shape. The vertical portion 500A of the link member 500 forms a bottom of the L-like shape and opposes the moving member 300. An end of the horizontal portion 500B is opposed and pinned to the contact portion 204A2 (depicted in FIG. 2) of the first actuation portion 204. The frame 400 is partially cut and bent to form the guide 400A. The horizontal portion 500B is inserted in the guide 400A. Thus, the guide 400A regulates the horizontal portion 500B to prevent the horizontal portion 500B from moving in a vertical direction when the horizontal portion 500B is moved in a horizontal direction.

Figure 9:
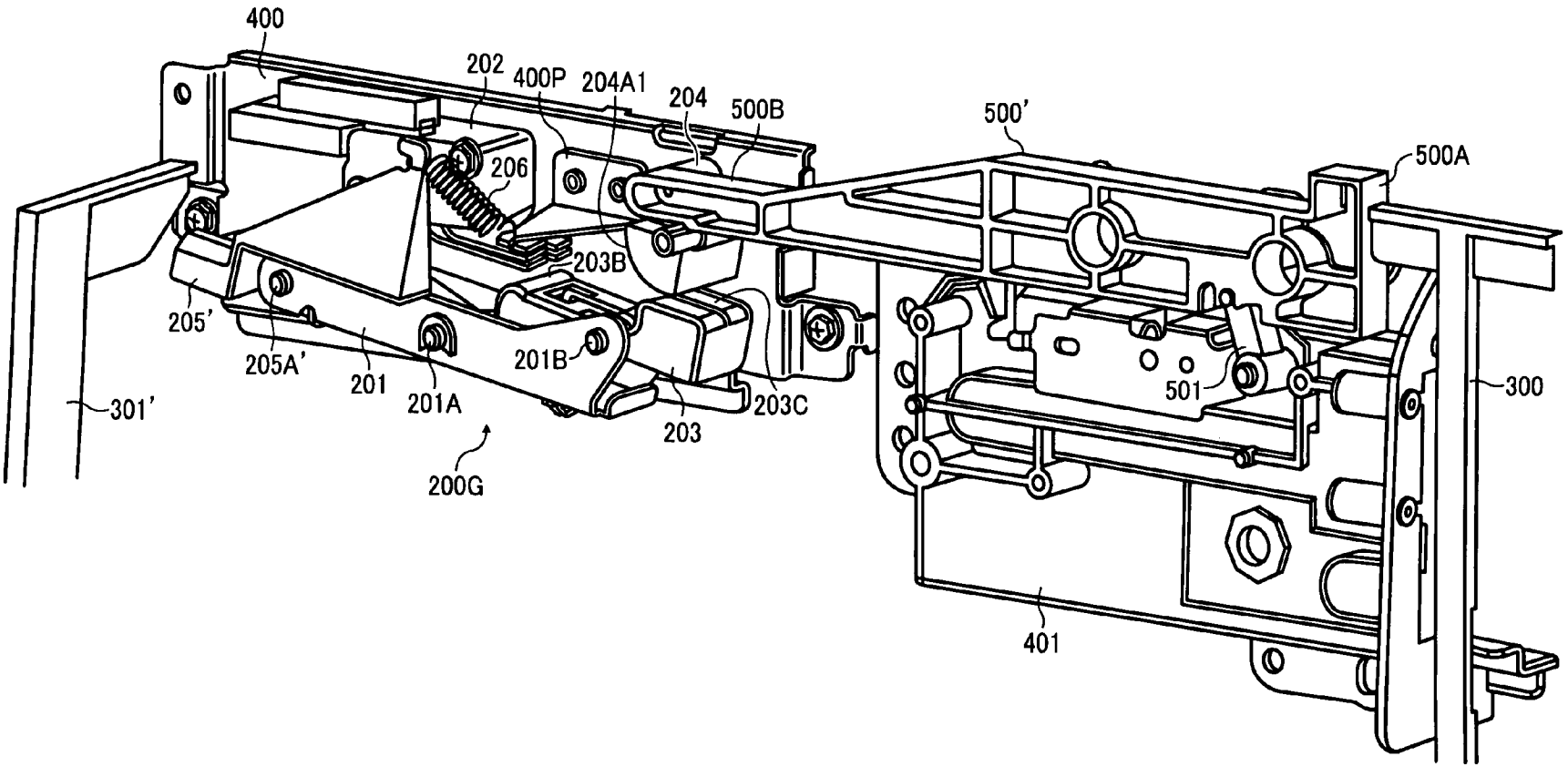
FIG. 9 is a perspective view of a switch actuation device according to yet another example embodiment.

Referring to FIG. 9, the following describes a switch actuation device 200G according to yet another example embodiment. FIG. 9 is a perspective view of the switch actuation device 200G and the moving members 300 and 301'. The switch actuation device 200G includes link members 500', and 501 and/or a frame 401. The link member 500' includes the vertical portion 500A and/or the horizontal portion 500B. The other elements of the switch actuation device 200G are common to the switch actuation device 200F (depicted in FIG. 8).

One end of the link member 500' is opposed and pinned to the contact portion 204A2 (depicted in FIG. 2) of the first actuation portion 204 opposing the second pivoting end 203C of the second lever 203. Another end of the link member 500' is provided near the moving member 300. The link member 501 is provided near the another end of the link member 500'. For example, a pivoting end of the link member 501 engages with a bottom surface of the link member 500'.

A swing track of the link member 501 corresponds to a rotation track of the one end of the link member 500' pinned to the contact portion 204A2 of the first actuation portion 204. The frame 401 is separately provided from the frame 400 to which the first lever 201 is attached via the support 201A. The link member 501 may move along a guide (not shown) provided on the frame 401 and allowing the link member 501 to move back and forth. A force applied to the link member 501 moves the link member 501 toward a position at which the moving member 300 pushes and moves the link member 501.

When the moving member 300 pushes and moves the link member 501, the first actuation portion 204 interlocked with an end of the link member 501 may swing the second lever 203 so that the second lever 203 turns on the switch 202.

Figure 10:
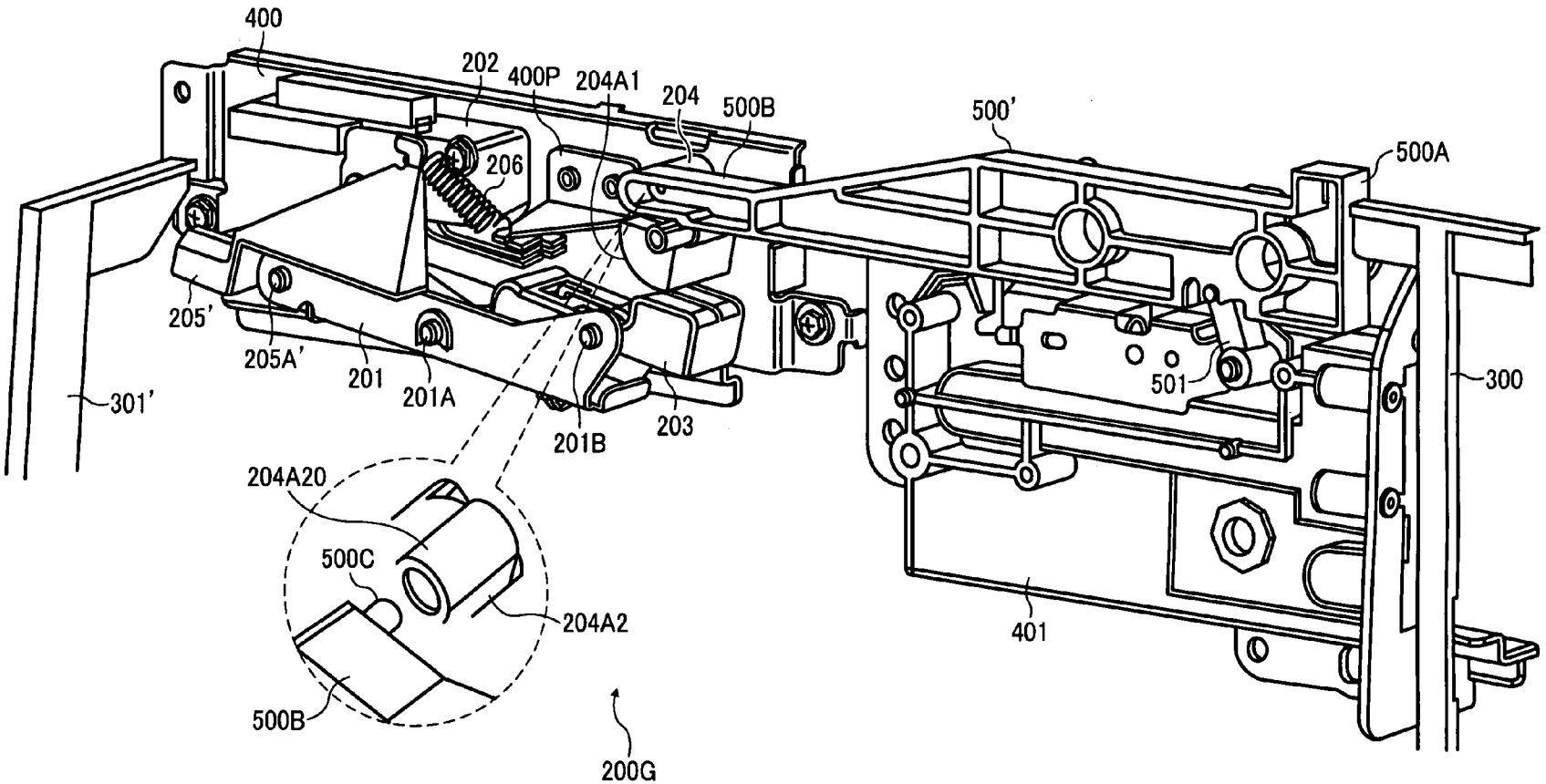
FIG. 10 is an enlarged perspective view (according to an example embodiment) of the switch actuation device shown in FIG. 9.

Referring to FIG. 10, the following describes an example structure for connecting the link member 500' with the first actuation portion 204. FIG. 10 is a perspective view of the switch actuation device 200G and the moving members 300 and 301'. The first actuation portion 204 further includes a cylindrical hole 204A20. The link member 500' further includes a spherical member 500C.

The spherical member 500C is integrated with the link member 500'. For example, the spherical member 500C is provided on the end of the horizontal portion 500B of the link member 500'. The cylindrical hole 204A20 is formed in the contact portion 204A2 of the first actuation portion 204. The spherical member 500C is attachable to and detachable from the cylindrical hole 204A20.

The spherical member 500C is inserted into and engaged with the cylindrical hole 204A20. Therefore, even when the link member 500' does not oppose the first actuation portion 204 precisely, the spherical member 500C and the cylindrical hole 204A20 engaged with each other may cause the link member 500' to move the first actuation portion 204 properly.

Figure 11:
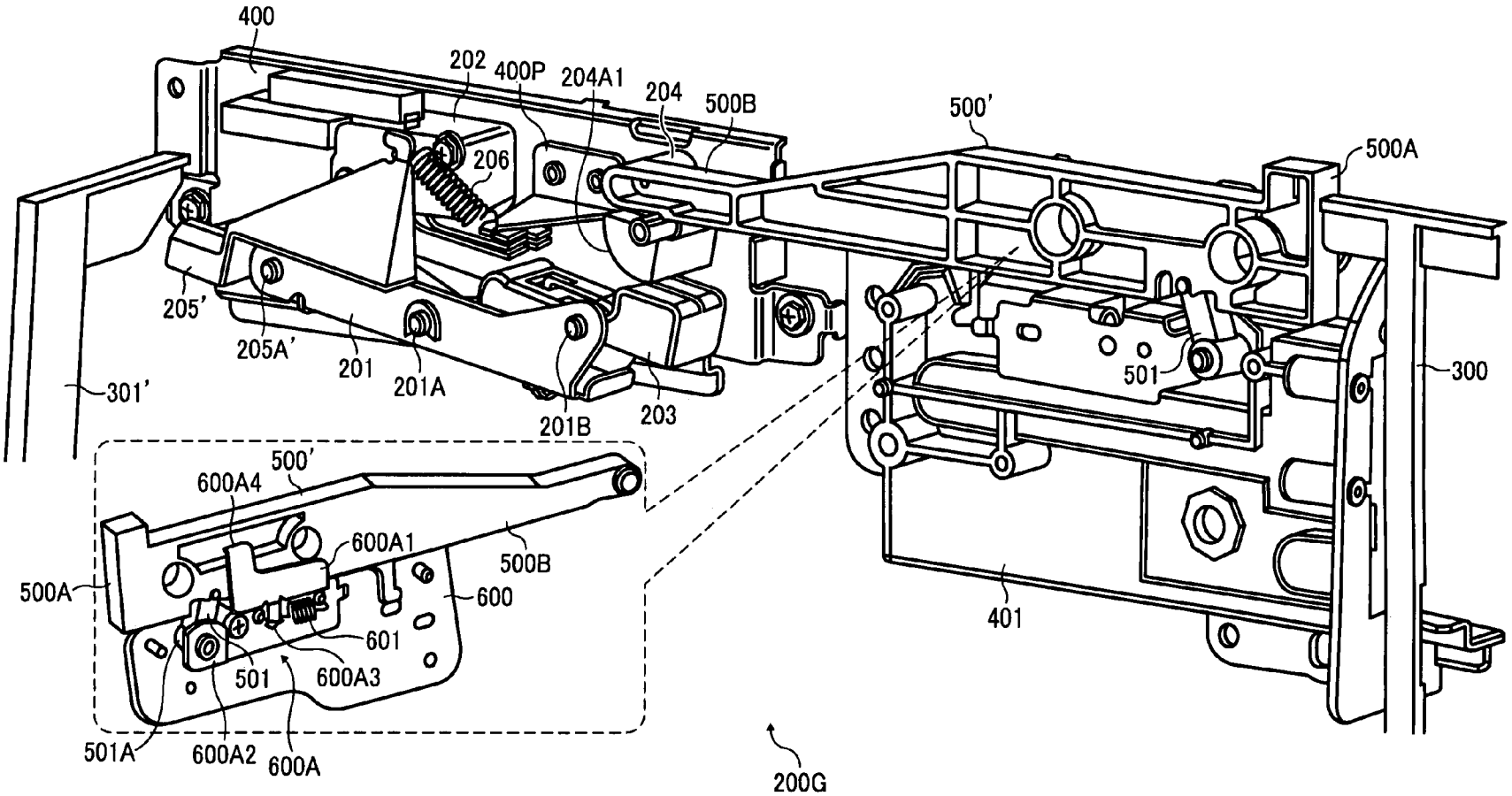
FIG. 11 is another enlarged perspective view (according to an example embodiment) of the switch actuation device shown in FIG. 9.

Referring to FIG. 11, the following describes an example structure for supporting the link member 500'. FIG. 11 is a perspective view of the switch actuation device 200G and the moving members 300 and 301'. The switch actuation device 200G further includes a base plate 600, a link member support 600A, and/or a support shaft 501A. The link member support 600A includes a slide guide 600A1, a shaft support 600A2, an elastic member 601, and/or a hook 600A3. The slide guide 601A1 includes a regulator 600A4.

The link member 500' may be a module attached to the frame 401 via the base plate 600. The base plate 600 is attached to the frame 401. The link member support 600A is separately provided from the base plate 600.

The slide guide 600A1 holds a bottom of the link member 500' and one end of the link member 500' is connected with the first actuation portion 204. The support shaft 501A is inserted into the shaft support 600A2 and slidably supports the link member 501. The hook 600A3 supports the elastic member 601. The elastic member 601 (e.g., a spring) is hooked on the hook 600A3 and the base plate 600, and applies a habit for moving the link member 500' toward the moving member 300. The regulator 600A4 is provided in an upper portion of the slide guide 600A1 to form a wing entering a concave portion of the link member 500'.

The slide guide 600A1 of the link member support 600A catches and holds the link member 500'. The link member support 600A is attached to the base plate 600 in such a manner that the support shaft 501A inserted in the shaft support 600A2 slidably supports the link member 501. The elastic member 601 is hooked on the base plate 600 and the hook 600A3. Thus, the link member 501 may detect movement of the moving member 300. With the above-described structure, even when the first actuation portion 204 is provided apart from the moving member 300, the link members 500' and 501 may interlock the moving member 300 with the first actuation portion 204.

Referring to FIGS. 12 to 15, the following describes operations of the switch actuation device 200G using the link members 500' and 501. FIGS. 12 to 15 illustrate a sectional view of the switch actuation device 200G.

Figure 12:
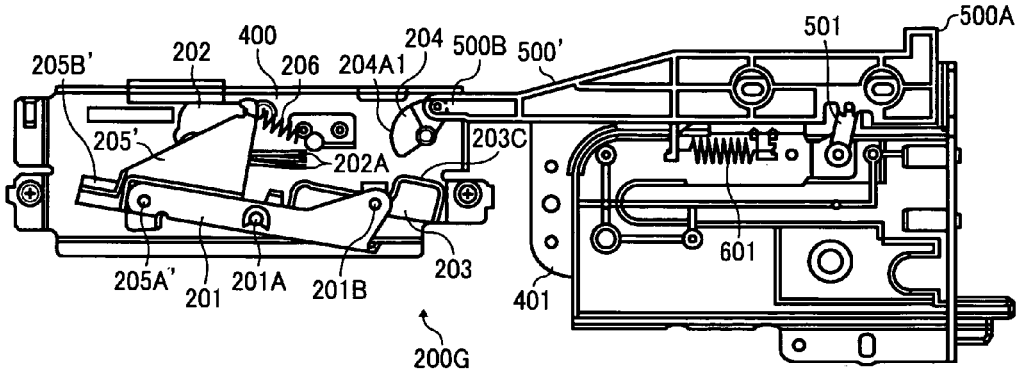
FIG. 12 is a sectional view (according to an example embodiment) of the switch actuation device shown in FIG. 9 when both moving members included in the image forming apparatus shown in FIG. 1 do not drive the switch actuation device.

FIG. 12 illustrates the switch actuation device 200G when both the moving members 300 and 301' (depicted in FIG. 11) do not drive the switch actuation device 200G. The first actuation portion 204 does not contact the second lever 203. Therefore, the second lever 203 is separated from the actuator 202A for actuating the switch 202.

Figure 13:
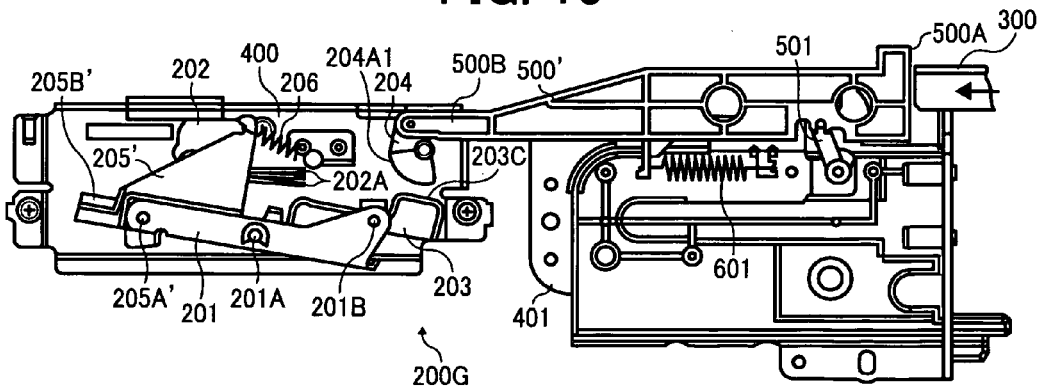
FIG. 13 is a sectional view (according to an example embodiment) of the switch actuation device shown in FIG. 12 when one of moving members included in the image forming apparatus shown in FIG. 1 drives the switch actuation device.

FIG. 13 illustrates the switch actuation device 200G when the moving member 300 drives the switch actuation device 200G. When the moving member 300 drives the link member 500', for example, when the front cover 24 (depicted in FIG. 1) is closed and the protrusion 24A (depicted in FIG. 1) equivalent to the moving member 300 drives the link member 500', the link member 501 and the link member support 600A (depicted in FIG. 11) guide the link member 500' so that the link member 500' rotates the first actuation portion 204 via a connecting portion (e.g., the spherical member 500C depicted in FIG. 10) provided in an end of the link member 500'. Accordingly, the arc portion 204A1 opposes the second pivoting end 203C of the second lever 203.

Figure 15:
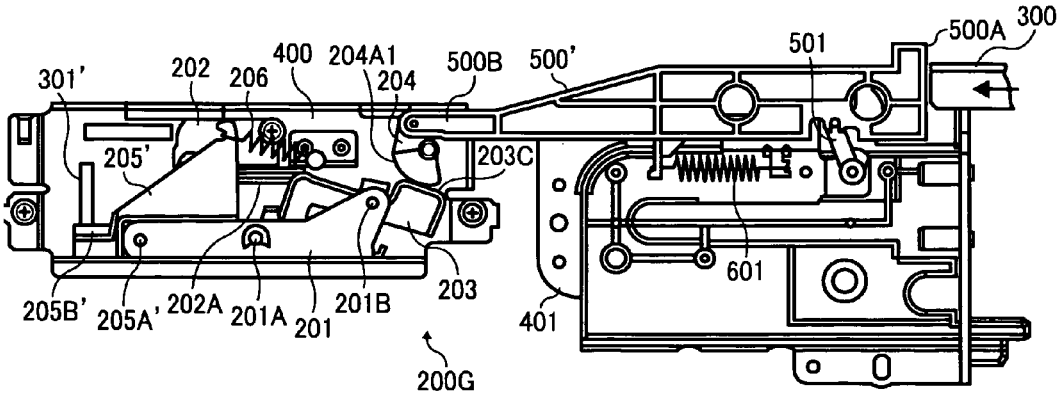
FIG. 15 is a sectional view (according to an example embodiment) of the switch actuation device shown in FIG. 12 when both moving members included in the image forming apparatus shown in FIG. 1 drive the switch actuation device.

FIG. 15 illustrates the switch actuation device 200G when both the moving members 300 and 301' drive the switch actuation device 200G. When the moving member 301' drives the second actuation portion 205', for example, when the right cover 25 (depicted in FIG. 1) is closed and the protrusion 25A (depicted in FIG. 1) equivalent to the moving member 301' drives the second actuation portion 205', the second actuation portion 205' swings the first lever 201 and thereby moves the support shaft 201B provided in the first lever 201 and supporting the second lever 203. When the second pivoting end 203C of the second lever 203 hits and stops against the arc portion 204A1 of the first actuation portion 204, the second lever 203 swings about a contact portion at which the second lever 203 contacts the arch portion 204A1 in a direction in which the second lever 203 pushes and moves the actuator 202A for actuating the switch 202. Thus, a single switch (e.g., the switch 202) may detect that the front cover 24 and the right cover 25 (depicted in FIG. 1) are closed properly.

Figure 14:
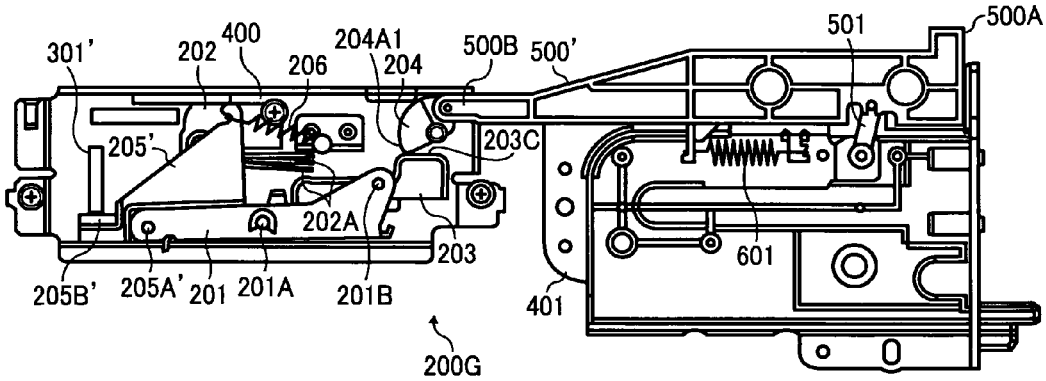
FIG. 14 is a sectional view (according to an example embodiment) of the switch actuation device shown in FIG. 12 when another one of moving members included in the image forming apparatus shown in FIG. 1 drives the switch actuation device.

FIG. 14 illustrates the switch actuation device 200G when the moving member 301' drives the switch actuation device 200G. When the moving member 301' (e.g., the protrusion 25A depicted in FIG. 1) pushes and moves the first lever 201 via the second actuation portion 205' before the moving member 300 (e.g., the protrusion 24A depicted in FIG. 1) does, the first lever 201 swings the second lever 203 so that the second lever 203 opposes the first actuation portion 204.

As illustrated in FIG. 15, when the moving member 300 pushes and moves the moving member 500', the arc portion 204A1 of the first actuation portion 204 contacts the second pivoting end 203C of the second lever 203. Accordingly, the second lever 203 swings about the support shaft 201B in a direction in which the second lever 203 pushes and moves the actuator 202A for actuating the switch 202.

The switch actuation device, that is, the switch actuation device 200 (depicted in FIG. 2), 200A (depicted in FIG. 3), 200B (depicted in FIG. 4), 200C (depicted in FIG. 5), 200D (depicted in FIG. 6), 200E (depicted in FIG. 7), 200F (depicted in FIG. 8), and 200G (depicted in FIG. 9), may be used as an interlock mechanism for the image forming apparatus 100 (depicted in FIG. 1).

As illustrated in FIG. 1, when the switch actuation device 200 is installed in the image forming apparatus 100, the protrusion 25A provided on the right cover 25 may serve as the moving member 301 (depicted in FIG. 2), 301' (depicted in FIG. 5), or 302 (depicted in FIG. 6). The protrusion 24A provided on the front cover 24 may serve as the moving member 300 (depicted in FIG. 2) or 300' (depicted in FIG. 3). The right cover 25 and the front cover 24 may move or swing in directions different from each other so that the right cover 25 and the front cover 24 are opened and closed.

As illustrated in FIG. 2, when the switch actuation device 200 is provided to correspond to the front cover 24 and the right cover 25 (depicted in FIG. 1) provided adjacent and perpendicular to the front cover 24, the first lever 201 and the second lever 203 swing on a vertical plane. Further, the first actuation portion 204, which contacts the second pivoting end 203C of the second lever 203, does not slide by stroke but rotates to contact the second lever 203. Thus, the switch actuation device 200 may occupy reduced space on a horizontal plane and may prevent unstable stroke for actuating the switch 202 due to varied stroke caused by processing error.

Figure 16:
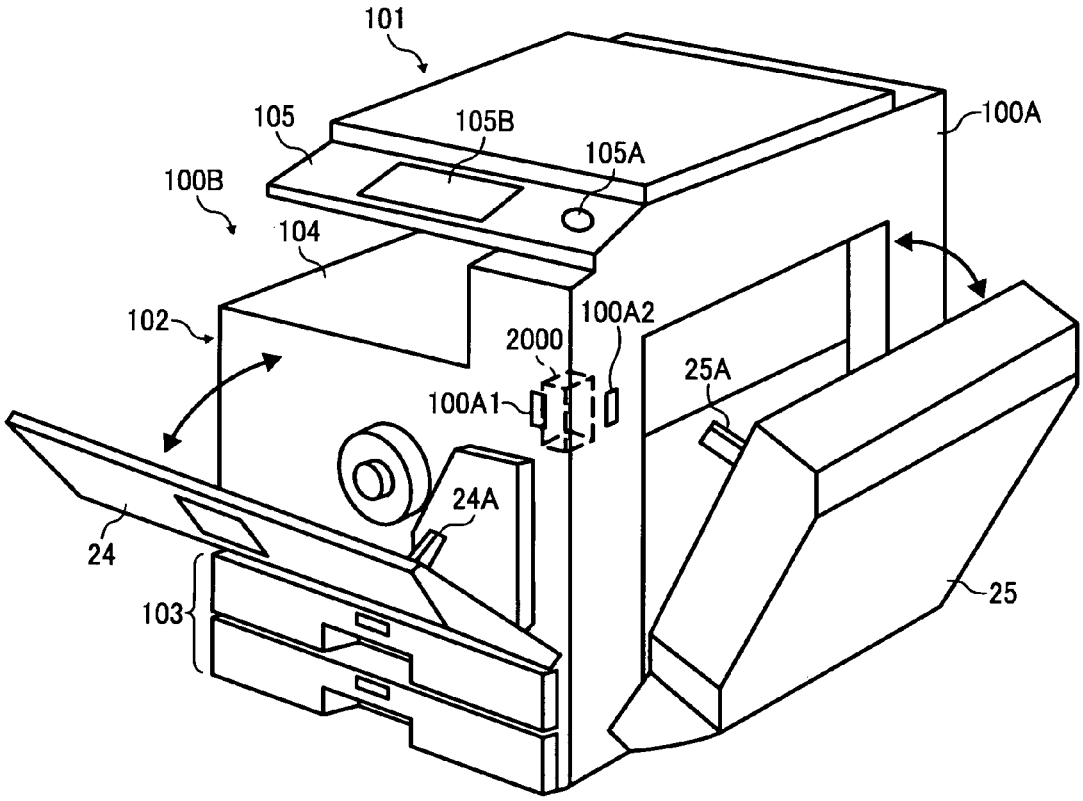
FIG. 16 is a perspective view of an image forming apparatus according to yet another example embodiment.

Referring to FIG. 16, the following describes an image forming apparatus 100B according to yet another example embodiment. FIG. 16 is a perspective view of the image forming apparatus 100B. The image forming apparatus 100B includes the elements included in the image forming apparatus 100 depicted in FIG. 1, except for a switch actuation device 2000 replacing the switch actuation device 200. However, the opening 100A1 and the protrusion 24A of the image forming apparatus 100B are provided at positions different from the positions in the image forming apparatus 100.

The protrusion 24A is provided at a position on the inner surface of the front cover 24 near the right cover 25. The protrusion 25A is provided at a position on the inner surface of the right cover 25 near the protrusion 24A on the front cover 24. The openings 100A1 and 100A2 are provided in the body 101A and oppose the protrusions 24A and 25A, respectively. Thus, the protrusions 24A and 25A are inserted into the openings 100A1 and 100A2, respectively.

The switch actuation device 2000 is provided in a space inside the body 101A into which the protrusions 24A and 25A provided on the front cover 24 and the right cover 25 are inserted via the openings 100A1 and 100A2, respectively. The switch actuation device 2000 serves as an interlock mechanism which uses the protrusions 24A and 25A as moving members.

Figure 17:
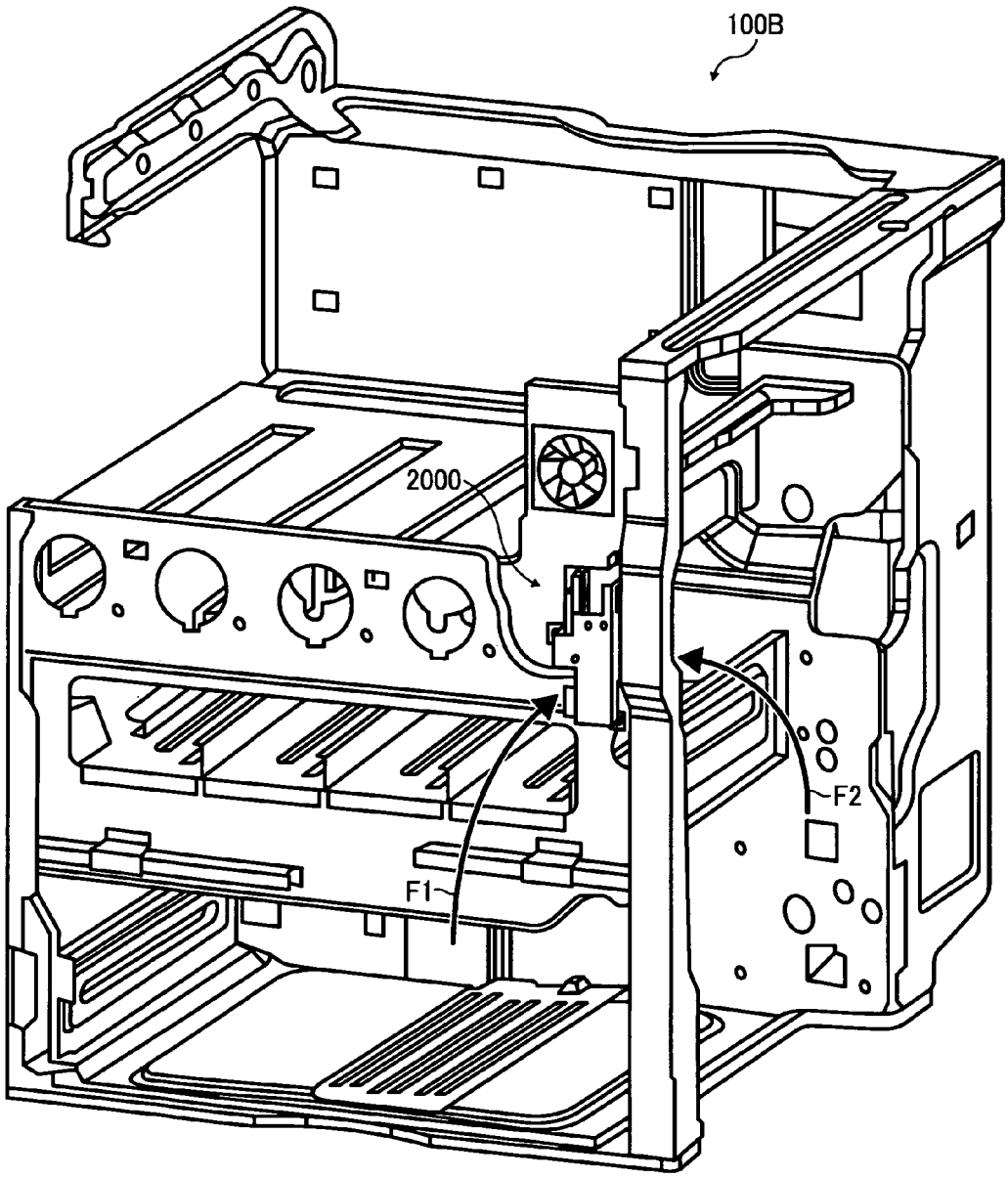
FIG. 17 is a perspective view (according to an example embodiment) of the image forming apparatus shown in FIG. 16 without exterior covers.

FIG. 17 is a perspective view of the image forming apparatus 100B from which exterior covers of the body 100A (depicted in FIG. 16) are removed. The switch actuation device 2000 is provided in a corner of the body 100A. Directions F1 and F2 illustrate tracks through which the protrusions 24A and 25A (depicted in FIG. 16) enter the body 100A, respectively.

Figure 18:
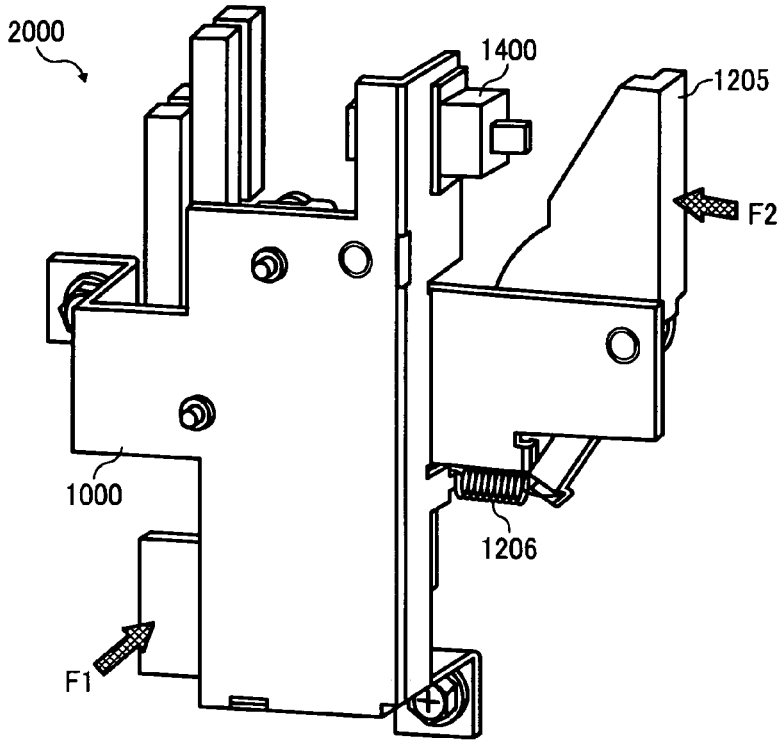
FIG. 18 is an external view (according to an example embodiment) of a switch actuation device included in the image forming apparatus shown in FIG. 17.
Figure 19:
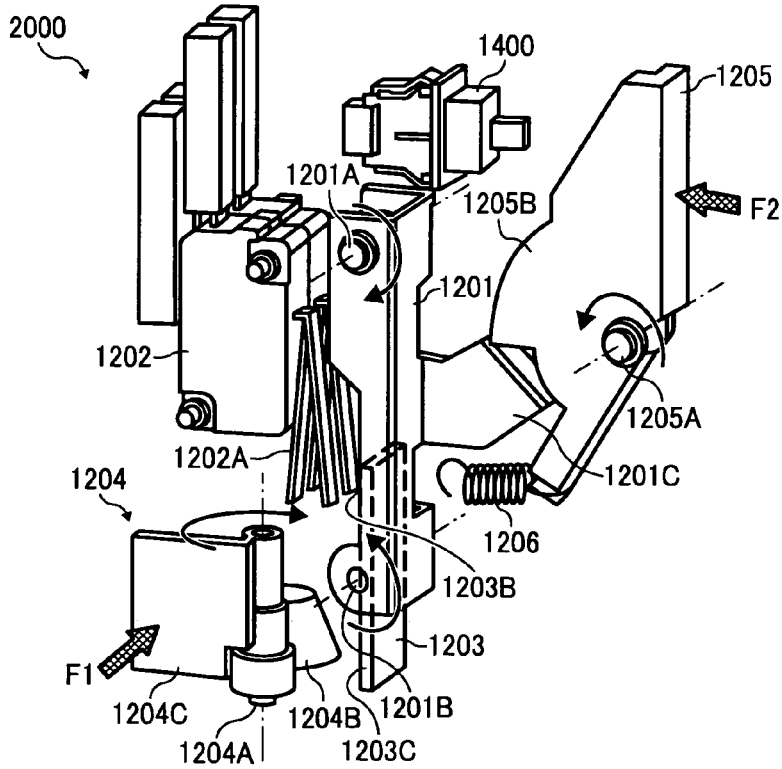
FIG. 19 is a perspective view (according to an example embodiment) of the switch actuation device shown in FIG. 18.

Referring to FIGS. 18 and 19, the following describes the switch actuation device 2000. FIG. 18 is an external view of the switch actuation device 2000. FIG. 19 is a perspective view of the switch actuation device 2000 and a switch 1202. As illustrated in FIG. 18, the switch actuation device 2000 includes a cover 1000, a second actuation portion 1205, a detection switch 1400, and/or an elastic member 1206. As illustrated in FIG. 19, the switch actuation device 2000 further includes a first lever 1201, a second lever 1203, a support shaft 1201A, a support shaft 1201B, an actuator 1202A, and/or a first actuation portion 1204. The first lever 1201 includes an actuation wing 1201C. The second lever 1203 includes a first pivoting end 1203B and/or a second pivoting end 1203C. The first actuation portion 1204 includes a rotation shaft 1204A, a cam 1204B, and/or an actuation wing 1204C. The second actuation portion 1205 includes a rotation shaft 1205A and/or a cam 1205B.

As illustrated in FIG. 18, the cover 1000 is attached to the body 100A (depicted in FIG. 16). The protrusions 24A and 25A (depicted in FIG. 16) move in the directions F1 and F2, respectively, to enter the body 100A so as to turn on the switch actuation device 2000.

FIG. 19 is a perspective view of the switch actuation device 2000 when the cover 1000 (depicted in FIG. 18) is removed. The first lever 1201 swings about the support shaft 1201A on a vertical plane. In a default state, the first lever 1201 is maintained at a position at which the first lever 1201 does not drive the switch 1202. The support shaft 1201B is provided at one end of the first lever 1201. The support shaft 1201B supports the second lever 1203 in such a manner that both ends (e.g., the first pivoting end 1203B and the second pivoting end 1203C) of the second lever 1203 swing about the support shaft 1201B on a vertical plane. One pivoting end (e.g., the first pivoting end 1203B) of the second lever 1203 opposes the actuator 1202A for actuating the switch 1202. The switch 1202 turns on and off a power source. The first actuation portion 1204 opposes and contacts another pivoting end (e.g., the second pivoting end 1203C) of the second lever 1203. For example, the first actuation portion 1204 may oppose and contact the second lever 1203 at a substantially identical position on the second lever 1203. When the protrusion 24A serving as a moving member and provided on the front cover 24 (depicted in FIG. 16) moves in the direction F1 and thereby pushes and moves the first actuation portion 1204, the first actuation portion 1204 drives the second lever 1203 so that the first pivoting end 1203B of the second lever 1203 drives the actuator 1202A.

The actuation wing 1201C is provided on a pivoting end of the first lever 1201. When the protrusion 25A serving as a moving member and provided on the right cover 25 (depicted in FIG. 16) moves in the direction F2 and thereby pushes and moves the second actuation portion 1205, the second actuation portion 1205 moves the first lever 1201 closer to the actuator 1202A. The detection switch 1400 opposes one pivoting end of the second actuation portion 1205. When the second actuation portion 1205 separates from the detection switch 1400 and thereby does not contact the detection switch 1400, the detection switch 1400 is turned on to notify that the right cover 25 is opened.

Figure 20A:
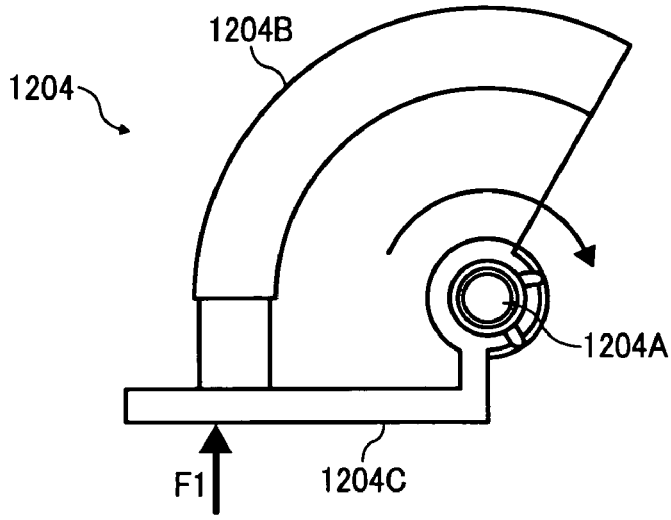
FIG. 20A is a plane view (according to an example embodiment) of a first actuation portion included in the switch actuation device shown in FIG. 19.
Figure 20B:
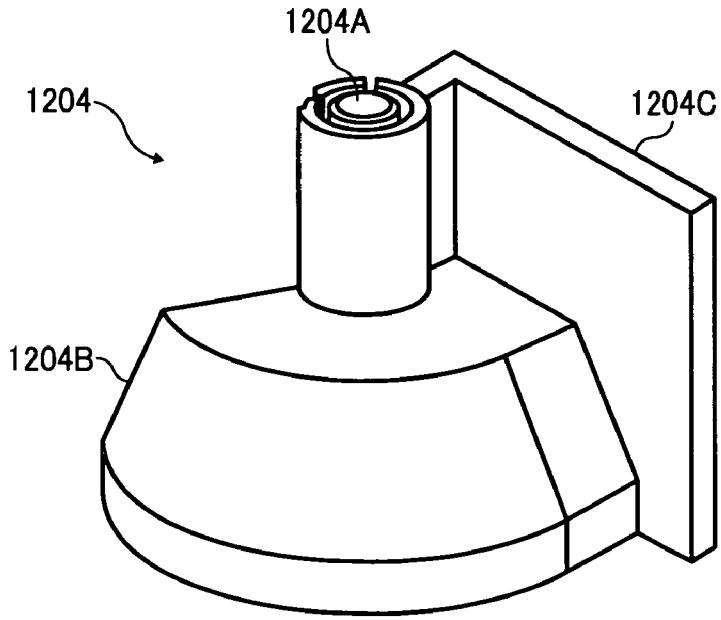
FIG. 20B is a perspective view (according to an example embodiment) of the first actuation portion shown in FIG. 20A.

FIG. 20A is a plane view of the first actuation portion 1204. FIG. 20B is a perspective view of the first actuation portion 1204. In the first actuation portion 1204, when the protrusion 24A provided on the front cover 24 (depicted in FIG. 16) moves in the direction F1, the cam 1204B and the actuation wing 1204C rotate about the rotation shaft 1204A in a direction corresponding to the direction F1. The cam 1204B includes an arc surface formed around the rotation shaft 1204A. The actuation wing 1204C serves as a contact portion contacted by the protrusion 24A provided on the front cover 24, and is pushed and moved by the protrusion 24A. For example, as illustrated in FIG. 19, when the protrusion 24A enters the body 100A via the opening 100A1 (depicted in FIG. 16), the protrusion 24A pushes and moves the actuation wing 1204C. Accordingly, the cam 1204B rotates and moves the second lever 1203 so that first pivoting end 1203B of the second lever 1203 moves toward the actuator 1202A.

The second actuation portion 1205 rotates about the rotation shaft 1205A in a direction corresponding to the direction F2 in which the protrusion 25A provided on the right cover 25 (depicted in FIG. 16) moves. The cam 1205B includes an arc surface formed at a position on the second actuation portion 1205 at which the arc surface of the cam 1205B may oppose and contact the actuation wing 1201C provided on the first lever 1201.

The elastic member 1206 (e.g., a spring) is hooked on the cover 1000 (depicted in FIG. 18) and the second actuation portion 1205. The elastic member 1206 applies a force to the second actuation portion 1205 so that the second actuation portion 1205 has a habit of constantly moving toward the protrusion 25A. Thus, the second actuation portion 1205 may be sensitive to movement of the protrusion 25A.

The first actuation portion 1204 and the second actuation portion 1205 rotate in the directions corresponding to the directions F1 and F2 in which the protrusions 24A and 25A move, respectively. Therefore, the first actuation portion 1204 may occupy a space needed for the cam 1204B and the actuation wing 1204C to rotate about the rotation shaft 1204A. Similarly, the second actuation portion 1205 may occupy a space needed for the cam 1205B to rotate about the rotation shaft 1205A. Namely, the rotating first actuation portion 1204 and the rotating second actuation portion 1205 may occupy a smaller space compared to a case in which the first actuation portion 1204 and the second actuation portion 1205 move back and forth. Further, a reaction force is applied to the protrusions 24A and 25A in directions in which the protrusions 24A and 25A extend. Therefore, an accidental load may not be applied to the protrusions 24A and 25B, resulting in an improved durability of the protrusions 24A and 25B.

The cams 1204B and 1205B oppose and contact the second lever 1203 and the first lever 1201, respectively. Therefore, even when an amount of entry of the protrusions 24A and 25B entering the body 100A (depicted in FIG. 16) varies or even when the front cover 24 and the right cover 25 are closed by varied forces, the second lever 1203 and the first lever 1201 may swing if the cams 1204B and 1205B rotate. For example, variation in the amount of entry of the protrusions 24A and 25B entering the body 100A due to an assembly error in assembling the front cover 24 and the right cover 25 may not affect sensitivity of the second lever 1203 and the first lever 1201 and thereby may maintain proper movement of the second lever 1203 and the first lever 1201, respectively.

The detection switch 1400 is provided on a track on which one pivoting end of the second actuation portion 1205 rotates. Therefore, the detection switch 1400 may detect a condition in which the switch 1202 is not turned on, that is, a condition in which the right over 25 is not closed properly. The right cover 25 is frequently opened and closed to cope with paper jam. The detection switch 1400 corresponds to the second actuation portion 1205 driven by the right cover 25. Thus, the detection switch 1400 may check if the right cover 25, which is frequently opened and closed, is properly closed.

An elastic member (not shown) applies a force to the first lever 1201 so that the actuation wing 1201C has a habit for contacting the cam 1205B of the second actuation portion 1205. Thus, the first lever 1201 may be pushed and moved by the second actuation portion 1205 with an increased sensitivity.

Referring to FIGS. 21A, 21B, 22A, 22B, 23A, 23B, 24A, and 24B, the following describes turning on and off of the switch 1202 for turning on and off the power source in correspondence with closing and opening of the front cover 24 and the right cover 25 (depicted in FIG. 16).

Figure 21A:
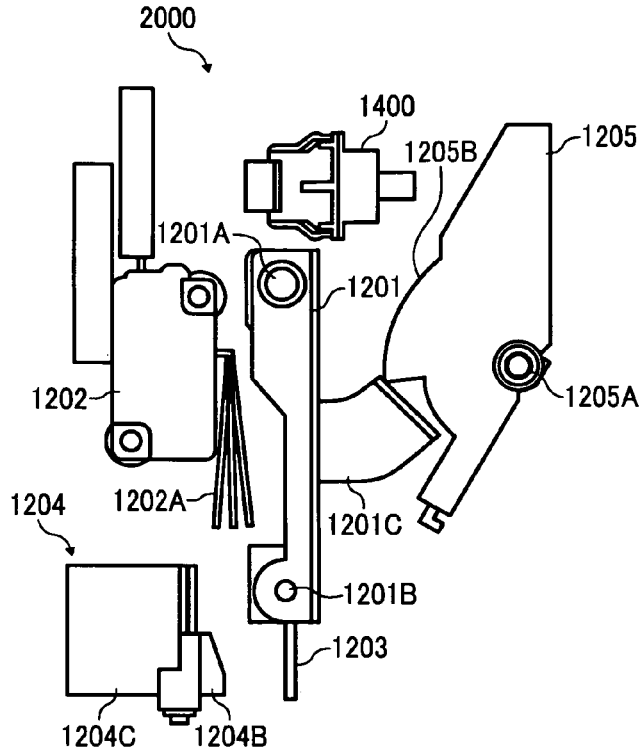
FIG. 21A is a side view (according to an example embodiment) of the switch actuation device shown in FIG. 19 when both a front cover and a right cover included in the image forming apparatus shown in FIG. 16 are opened.
Figure 21B:
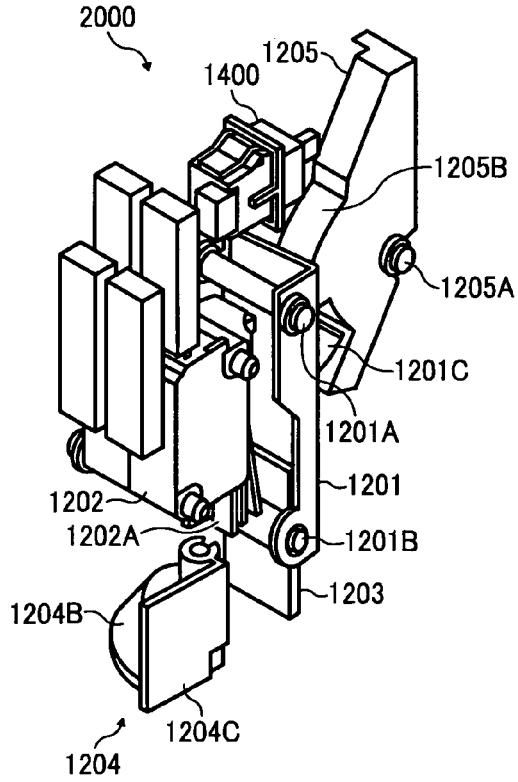
FIG. 21B is a perspective view (according to an example embodiment) of the switch actuation device shown in FIG. 21A.

FIG. 21A is a side view of the switch actuation device 2000 when both the front cover 24 and the right cover 25 are opened. FIG. 21B is a perspective view of the switch actuation device 2000 when both the front cover 24 and the right cover 25 are opened. A default habit of the first lever 1201 rotates the first lever 1201 toward the cam 1205B of the second actuation portion 1205. Accordingly, the second lever 1203 separates from the actuator 1202A. The cam 1204B of the first actuation portion 1204 does not oppose and contact the second lever 1203. Thus, the switch 1202 is maintained off. The second actuation portion 1205 separates from the detection switch 1400 and thereby does not contact the detection switch 1400. Accordingly, the detection switch 1400 notifies that the right cover 25 is opened.

Figure 22A:
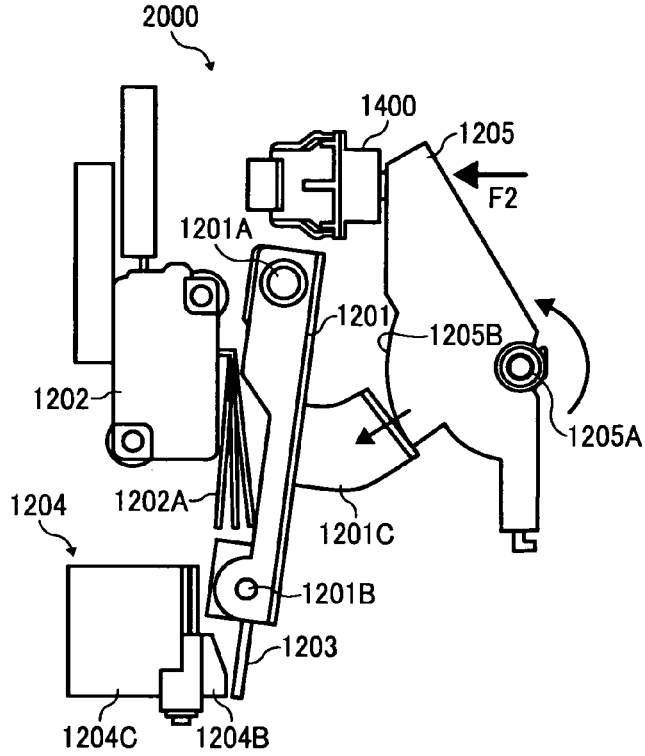
FIG. 22A is a side view (according to an example embodiment) of the switch actuation device shown in FIG. 19 when only a right cover included in the image forming apparatus shown in FIG. 16 is closed.
Figure 22B:
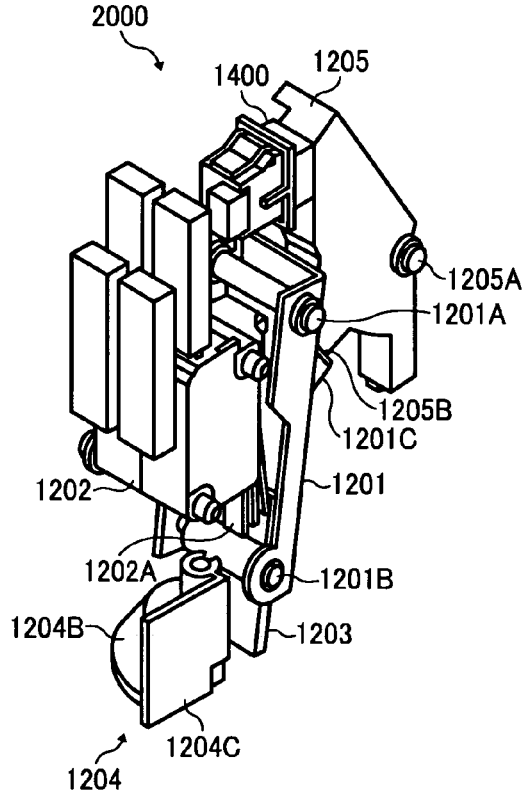
FIG. 22B is a perspective view (according to an example embodiment) of the switch actuation device shown in FIG. 22A.

FIG. 22A is a side view of the switch actuation device 2000 when only the right cover 25 is closed. FIG. 22B is a perspective view of the switch actuation device 2000 when only the right cover 25 is closed. The protrusion 25A (depicted in FIG. 16) provided on the right cover 25 pushes and moves the second actuation portion 1205 in the direction F2. Accordingly, the second actuation portion 1205 rotates and swings the first lever 1201 closer to the switch 1202, and pushes the detection switch 1400.

On the other hand, the first actuation portion 1204 does not rotate because the front cover 24 is not closed. The second lever 1203 keeps on separating from the actuator 1202A. Thus, the switch 1202 keeps on being turned off.

Figure 23A:
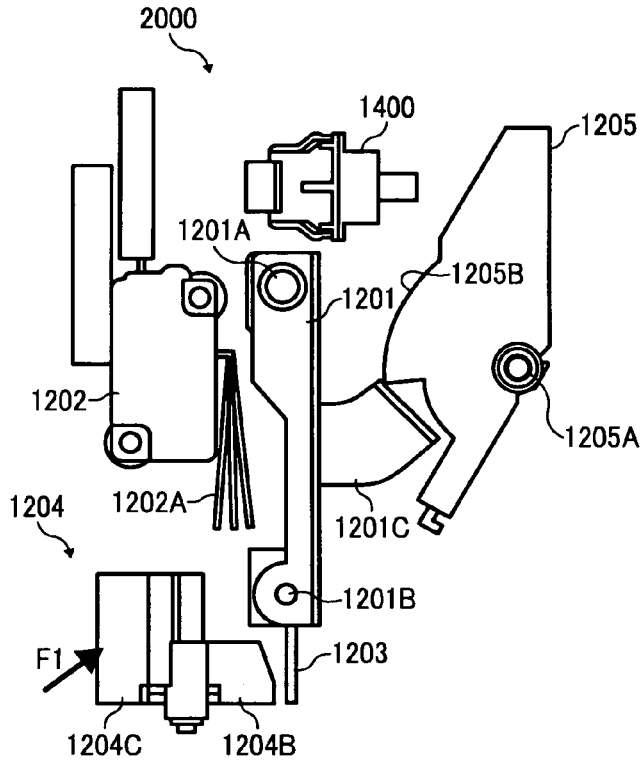
FIG. 23A is a side view (according to an example embodiment) of the switch actuation device shown in FIG. 19 when only a front cover included in the image forming apparatus shown in FIG. 16 is closed.
Figure 23B:
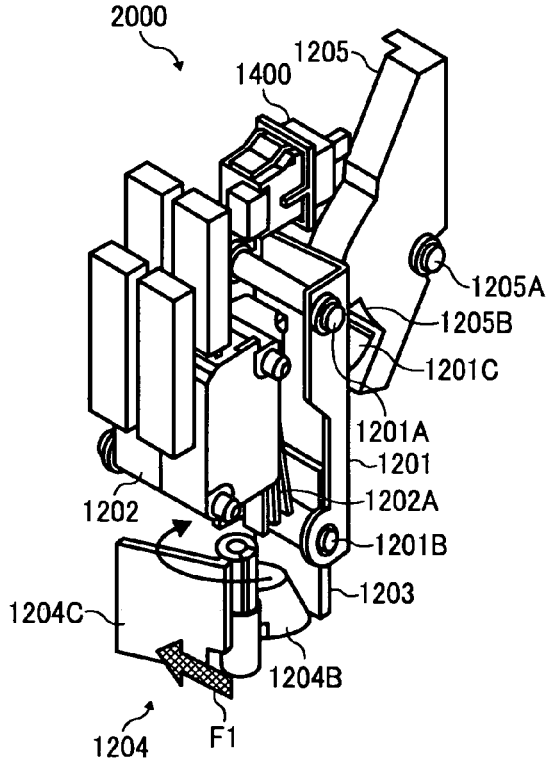
FIG. 23B is a perspective view (according to an example embodiment) of the switch actuation device shown in FIG. 23A.

FIG. 23A is a side view of the switch actuation device 2000 when only the front cover 24 is closed. FIG. 23B is a perspective view of the switch actuation device 2000 when only the front cover 24 is closed. The protrusion 24A (depicted in FIG. 16) provided on the front cover 24 pushes and moves the first actuation portion 1204 in the direction F1. Accordingly, the first actuation portion 1204 rotates and the cam 1204B moves closer to the second lever 1203.

On the other hand, the second actuation portion 1205 does not rotate because the right cover 25 is not closed. The first lever 1201 does not rotate because the second actuation portion 1205 does not push the first lever 1201. Accordingly, the first lever 1201 does not move closer to the switch 1202. Namely, combination of rotations of the first lever 1201 and the second lever 1203 does not generate. Thus, the switch 1202 is not driven and keeps on being turned off.

Figure 24A:
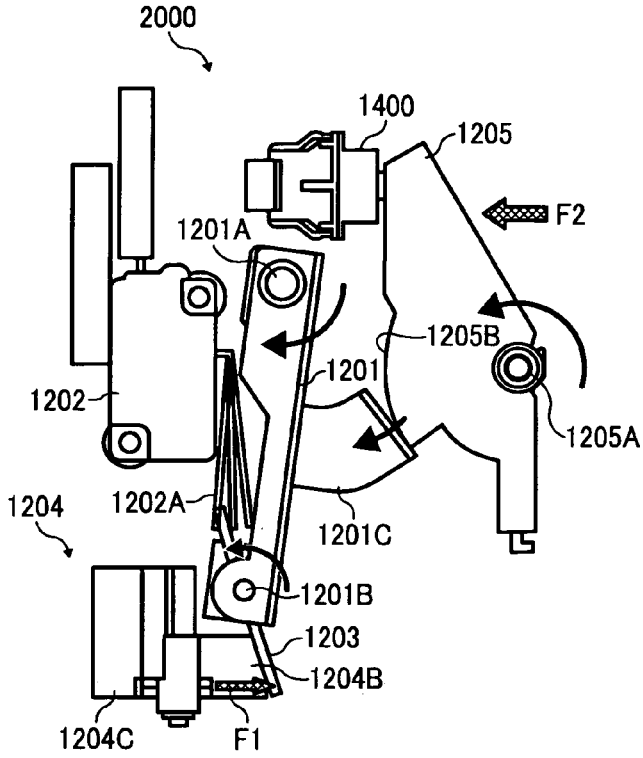
FIG. 24A is a side view (according to an example embodiment) of the switch actuation device shown in FIG. 19 when both a front cover and a right cover included in the image forming apparatus shown in FIG. 16 are closed.
Figure 24B:
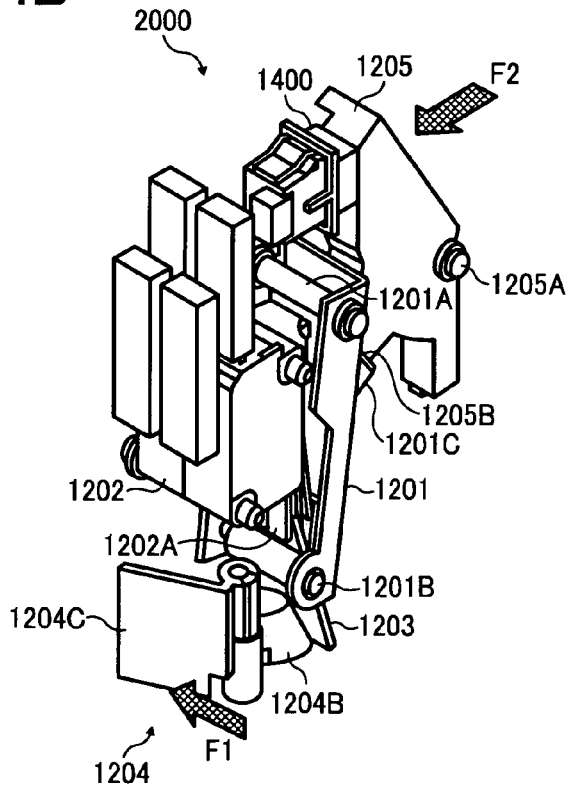
FIG. 24B is a perspective view (according to an example embodiment) of the switch actuation device shown in FIG. 24A.

FIG. 24A is a side view of the switch actuation device 2000 when both the front cover 24 and the right cover 25 are closed. FIG. 24B is a perspective view of the switch actuation device 2000 when both the front cover 24 and the right cover 25 are closed. The second actuation portion 1205 rotates and moves the first lever 1201 closer to the switch 1202. The first actuation portion 1204 rotates and the cam 1204B pushes and moves the second lever 1203 provided on the first lever 1201. Accordingly, the second lever 1203 presses the actuator 1202A. The actuator 1202A turns on the switch 1202 and the switch 1202 turns on the power source of the image forming apparatus 100B (depicted in FIG. 16).

As described above, the protrusion 24A opposing the first actuation portion 1204 and the protrusion 25A opposing the second actuation portion 1205 turn on and off the switch 1202 in correspondence with closing and opening of the front cover 24 and the right cover 25, respectively. FIG. 25 is a lookup table showing a relation between closing and opening of the front cover 24 and the right cover 25 and turning on and off of the switch 1202.

As illustrated in FIG. 19, in the switch actuation device 2000 having the above-described structure and serving as an interlock mechanism for turning on and off the switch 1202 in correspondence with closing and opening of a plurality of covers (e.g., the front cover 24 and the right cover 25 depicted in FIG. 16), combination of movements of the second lever 1203 and the first lever 1201 may turn on and off the switch 1202. The first actuation portion 1204 and the second actuation portion 1205, serving as rotating members, may rotate to move the second lever 1203 and the first lever 1201, respectively. The first actuation portion 1204 and the second actuation portion 1205 do not need movement stroke. Thus, the switch actuation device 2000 may perform combination of movements by occupying a reduced space.

The detection switch 1400 corresponds to one of the actuation portions (e.g., the second actuation portion 1205 according to this example embodiment), which is used for driving the switch 1202, to detect opening and closing of the right cover 25. Thus, the switch actuation device 2000 may have a plurality of functions, such as a function to drive the switch 1202 and a function to detect opening and closing of the right cover 25, resulting in reduced elements and costs.

As illustrated in FIG. 4, in a switch actuation device (e.g., the switch actuation device 200B) according to the above-described example embodiments, in correspondence with movement of a moving member (e.g., the moving member 301), a first lever (e.g., the first lever 201) moves a second lever (e.g., the second lever 203) toward an actuator (e.g., the actuator 202A) for turning on a switch (e.g., the switch 202). In addition, in correspondence with movement of another moving member (e.g., the moving member 300), one pivoting end (e.g., the first pivoting end 203B) of the second lever moves toward the actuator. Combination of the movements of the first lever and the second lever may turn on and off the switch. Namely, the first lever and the second lever, which move in correspondence with movements of the moving members, may turn on and off the switch. Thus, the switch actuation device may turn on and off the switch with a simple structure without adding an extra step or an extra element other than the moving members.

A first actuation portion (e.g., the first actuation portion 204) opposes and contacts another pivoting end (e.g., the second pivoting end 203C) of the second lever at a substantially identical position. The first actuation portion serves as a cam-shaped rotating member. The another pivoting end of the second lever has a damper function, absorbing an error generated by the moving member and the first actuation portion opposing each other even when the first actuation portion does not contact the second lever at an increased area. As a result, movement resistance and varied processing accuracy, which may be generated by the first actuation portion contacting the second lever at the increased area, may not cause unstable switch operations.

As illustrated in FIG. 5, a second actuation portion (e.g., the second actuation portion 205') includes a slope (e.g., the slope 205B') having a gradient. Therefore, even when a moving member (e.g., the moving member 301') is manufactured with an unstable processing accuracy, the slope may push and move a first lever (e.g., the first lever 201) properly and thereby the first lever may turn on a switch (e.g., the switch 202) properly. Further, when a direction in which the slope is slanted is changed, the first lever may swing by using movement of the moving member moving in a direction different from a direction in which the first lever moves. Thus, the second actuation portion and the moving member may oppose each other flexibly in accordance with installation of a switch actuation device (e.g., the switch actuation device 200C).

As illustrated in FIG. 2, a first lever (e.g., the first lever 201) is separately provided from a second actuation portion (e.g., the second actuation portion 205). An elastic member (e.g., the elastic member 206) applies a default habit to the first lever. Thus, the elastic member may suppress a contact error between a moving member (e.g., the moving member 301) and the second actuation portion due to a dimensional error.

A frame (e.g., the frame 400) supports elements other than moving members (e.g., the moving members 300 and 301). Therefore, the elements other than the moving members may be manufactured into a single assembly with an improved accuracy. Accordingly, a switch (e.g., the switch 202), which has decreased sensitivity and detection gain and is manufactured at low costs, may be used.

As illustrated in FIG. 6, in addition to a first lever (e.g., the first lever 201), an additional lever (e.g., the third lever 207) may be added. The first lever and the additional lever may have a similar structure. Thus, a switch (e.g., the switch 202) may be turned on and off flexibly in accordance with a number of moving members (e.g., the moving members 300, 301', and 302) and directions in which the moving members move.

As illustrated in FIG. 8, a link member (e.g., the link member 500) opposing a first actuation portion (e.g., the first actuation portion 204) is inserted into a guide (e.g., the guide 400A) formed in a frame (e.g., the frame 400). Therefore, the guide may guide the link member to contact the first actuation portion in accordance with movement of the first actuation portion.

As illustrated in FIG. 9, a link member (e.g., the link member 500') is provided between a first actuation portion (e.g., the first actuation portion 204) including a cam (e.g., the arc portion 204A1) and a moving member (e.g., the moving member 300). The link member may move in accordance with a swing track of the cam. Thus, the first actuation portion may move in accordance with movement of the moving member. Accordingly, the first actuation portion may move a second lever (e.g., the second lever 203) properly. As a result, the second lever may turn on and off a switch (e.g., the switch 202) precisely.

A frame (e.g., the frame 400) supports the link member. Therefore, the link member is assembled with an increased accuracy.

As illustrated in FIGS. 12 to 15, a switch (e.g., the switch 202) is turned on and off in correspondence with movements of a plurality of moving members (e.g., the moving members 300 and 301'). The moving members rotate or swing a first actuation portion (e.g., the first actuation portion 204) and a second actuation portion (e.g., the second actuation portion 205'), respectively. The first actuation portion and the second actuation portion rotate a second lever (e.g., the second lever 203) and a first lever (e.g., the first lever 201), respectively. Thus, the second lever and the first lever may selectively turn on and off the switch. The first actuation portion and the second actuation portion do not slide but rotate or swing in directions in which the moving members move, respectively. Namely, the first actuation portion and the second actuation portion, which rotate or swing, may have a smaller size and occupy a smaller space compared to the first actuation portion and the second actuation portion configured to slide.

As illustrated in FIG. 19, a rotating first actuation portion (e.g., the first actuation portion 1204) contacting a second lever (e.g., the second lever 1203) and a rotating second actuation portion (e.g., the second actuation portion 1205) contacting a first lever (e.g., the first lever 1201) include cam-shaped portions (e.g., the cams 1204B and 1205B), respectively. Thus, even when moving members (e.g., the protrusions 24A and 25B depicted in FIG. 16) move with varied strokes, the first actuation portion and the second actuation portion may move the second lever and the first lever, respectively, if the moving members may move the first actuation portion and the second actuation portion, respectively. Namely, a switch (e.g., the switch 1202) may be turned oh and off properly without being affected by variation in processing.

As illustrated in FIG. 16, when an image forming apparatus (e.g., the image forming apparatus 100B) includes an interlock mechanism (e.g., the switch actuation device 2000), protrusions (e.g., the protrusions 24A and 25A) provided on covers (e.g., the front cover 24 and the right cover 25), respectively, of a body (e.g., the body 100A) may be used as moving members.

As illustrated in FIG. 19, the protrusions drive the first actuation portion and the second actuation portion, so that the first actuation portion and the second actuation portion do not slide but rotate. Thus, an error due to slide may be reduced. Even when the interlock mechanism includes a single switch, the interlock mechanism may provide accurate operations.

Further, one of the protrusions (e.g., the protrusion 24A depicted in FIG. 16) may be provided at a center of an inner surface of the cover (e.g., the front cover 24 depicted in FIG. 16). Thus, even when a reaction force generated when the switch is turned on deforms a portion having a low hardness, the protrusion may not contact the switch, preventing malfunction of the switch.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A switch actuation device for turning on and off a switch by movements of a plurality of moving members including a first moving member and a second moving member, the switch actuation device comprising:

a first actuation portion driven by the first moving member;

a second actuation portion driven by the second moving member;

a first lever to oppose the second actuation portion and swung by the second actuation portion when the second moving member contacts the second actuation portion;

a support shaft provided on the first lever;

a second lever to oppose the first actuation portion and swung about the support shaft by the first actuation portion when the first moving member drives the first actuation portion; and an actuator to oppose the second lever and connected to the switch, the second lever comprising:

a first pivoting end to oppose the actuator; and a second pivoting end provided opposite to the first pivoting end via the support shaft, the first actuation portion to contact the second pivoting end of the second lever to swing the second lever toward the actuator when driven by the first moving member, the second actuation portion to swing the first lever to cause the first lever to move the second lever closer to the actuator when driven by the second moving member, the actuator driven by a combination of the swing of the second lever caused by the first moving member and the movement of the second lever caused by the second moving member so as to turn on the switch.

2. The switch actuation device according to claim 1, wherein the first actuation portion comprises a cam.

3. The switch actuation device according to claim 2, wherein the first actuation portion further comprises:

a rotation shaft; and a contact portion provided at a position relative to the cam via the rotation shaft and configured to contact the first moving member.

4. The switch actuation device according to claim 2, further comprising:

a first link member provided between the first actuation portion and the first moving member; and a second link member provided near the first moving member to move on a track corresponding to a swing track of the cam of the first actuation portion to guide the first link member.

5. The switch actuation device according to claim 4, wherein the first actuation portion further comprises a hole provided relative to the cam and the first link member comprises a spherical member to engage the hole.

6. The switch actuation device according to claim 4, further comprising:

a first frame to support the first actuation portion, the second actuation portion, the first lever, the support shaft, the second lever, the actuator, and the switch; and a second frame provided separately from the first frame, wherein at least one of the first link member and the second link member is provided on the second frame.

7. The switch actuation device according to claim 1, wherein the first actuation portion comprises a flange provided on the second pivoting end of the second lever that functions as a damper.

8. The switch actuation device according to claim 1, wherein the second actuation portion comprises a sloped portion that swings the first lever when pressed by the second moving member.

9. The switch actuation device according to claim 8, further comprising:

a biasing mechanism to apply a force to the first lever, wherein the second actuation portion is integrated with the first lever.

10. The switch actuation device according to claim 1, further comprising:

a frame to support the first actuation portion, the second actuation portion, the first lever, the support shaft, the second lever, the actuator, and the switch.

11. The switch actuation device according to claim 10, further comprising:

a first support to support the first lever and provided loose from the frame;

a second support supported by the frame;

a third lever to swing about the second support, the third lever comprising:

a third pivoting end at which the first support is provided; and a fourth pivoting end provided opposite to the third pivoting end via the second support; and a third actuation portion provided on the fourth pivoting end of the third lever to swing the third lever when contacted by a third moving member so that the third lever moves the second lever closer to the actuator via the first lever.

12. The switch actuation device according to claim 10, further comprising:

a link member provided between the first actuation portion and the first moving member to oppose the first actuation portion; and a guide formed of the frame supporting the first actuation portion and in which the link member is inserted in such a manner that the link member opposes the first actuation portion.

13. The switch actuation device according to claim 1, wherein the first actuation portion moves in a direction corresponding to a direction in which the first moving member moves and the second actuation portion moves in a direction corresponding to a direction in which the second moving member moves.

14. The switch actuation device according to claim 13, further comprising:

a detection switch provided on a track on which one of the first actuation portion and the second actuation portion moves to detect movement of one of the first moving member and the second moving member.

15. The switch actuation device according to claim 13, wherein the first actuation portion comprises a cam including an arc surface to oppose and contact the second lever and the second actuation portion comprises a cam including an arc surface to oppose and contact the first lever.

16. An interlock mechanism, comprising:

an open-close detection switch to detect opening and closing of a plurality of covers including a first cover and a second cover; and a switch actuation device to turn on and off the switch by movements of a plurality of moving members including a first moving member provided on the first cover and a second moving member provided on the second cover, the switch actuation device comprising:

a first actuation portion driven by the first moving member;

a second actuation portion driven by the second moving member;

a first lever to oppose the second actuation portion and swung by the second actuation portion when the second moving member contacts the second actuation portion;

a support shaft provided on the first lever;

a second lever to oppose the first actuation portion and swung about the support shaft by the first actuation portion when the first moving member drives the first actuation portion; and an actuator to oppose the second lever and connected to the switch, the second lever comprising:

a first pivoting end to oppose the actuator; and a second pivoting end provided opposite to the first pivoting end via the support shaft;

the first actuation portion to contact the second pivoting end of the second lever to swing the second lever toward the actuator when driven by the first moving member, the second actuation portion to swing the first lever to cause the first lever to move the second lever closer to the actuator when driven by the second moving member, the actuator driven by a combination of the swing of the second lever caused by the first moving member and the movement of the second lever caused by the second moving member so as to turn on the switch.

17. An image forming apparatus, comprising:

an interlock mechanism comprising:

an open-close detection switch to detect opening and closing of a plurality of covers including a first cover and a second cover; and a switch actuation device to turn on and off the switch by movements of a plurality of moving members including a first moving member provided on the first cover and a second moving member provided on the second cover, the switch actuation device comprising:

a first actuation portion driven by the first moving member;

a second actuation portion driven by the second moving member;

a first lever to oppose the second actuation portion and swung by the second actuation portion when the second moving member contacts the second actuation portion;

a support shaft provided on the first lever;

a second lever to oppose the first actuation portion and swung about the support shaft by the first actuation portion when the first moving member drives the first actuation portion; and an actuator to oppose, the second lever and connected to the switch, the second lever comprising:

a first pivoting end to oppose the actuator; and a second pivoting end provided opposite to the first pivoting end via the support shaft;

the first actuation portion to contact the second pivoting end of the second lever to swing the second lever toward the actuator when driven by the first moving member, the second actuation portion to swing the first lever to cause the first lever to move the second lever closer to the actuator when driven by the second moving member, the actuator driven by a combination of the swing of the second lever caused by the first moving member and the movement of the second lever caused by the second moving member so as to turn on the switch.

18. The image forming apparatus according to claim 17, wherein the first cover and the second cover are provided in directions perpendicular to each other, and the switch actuation device detects opening and closing of the first cover and the second cover.

19. The image forming apparatus according to claim 18, wherein the first cover and the second cover are opened and closed, and wherein the first moving member is formed of a first protrusion provided on the first cover and opposing the first actuation portion and the second moving member is formed of a second protrusion provided on the second cover and opposing the second actuation portion.

20. The image forming apparatus according to claim 19, wherein the first cover and the second cover are disposed perpendicular to each other, one of the first cover and the second cover is a front cover provided on a front of the image forming apparatus, and the protrusion provided on the one of the first cover and the second cover is disposed on one of a center and a corner of the front cover.

* * * * *